US009091113B2

(12) United States Patent
Pilgrim et al.

(10) Patent No.: US 9,091,113 B2
(45) Date of Patent: Jul. 28, 2015

(54) SAFETY GATE

(75) Inventors: Greg Pilgrim, Chicago, IL (US); Keith Alsberg, Evanston, IL (US); Mikael Bäckström, Chicago, IL (US)

(73) Assignee: Pilgrim Family Enterprises LLC, Chicago, IL (US)

( * ) Notice: Subject to any disclaimer, the term of this patent is extended or adjusted under 35 U.S.C. 154(b) by 99 days.

(21) Appl. No.: 13/401,800

(22) Filed: Feb. 21, 2012

(65) Prior Publication Data

US 2012/0211182 A1 Aug. 23, 2012

Related U.S. Application Data

(60) Provisional application No. 61/444,966, filed on Feb. 21, 2011.

(51) Int. Cl.

| | |
|---|---|
| ***A47G 5/00*** | (2006.01) |
| ***E06B 3/30*** | (2006.01) |
| ***E06B 9/24*** | (2006.01) |
| ***E06B 3/38*** | (2006.01) |
| ***E06B 7/00*** | (2006.01) |
| ***E06B 9/01*** | (2006.01) |
| ***E06B 9/06*** | (2006.01) |
| *E06B 9/00* | (2006.01) |

(52) U.S. Cl.

CPC ..... *E06B 9/06* (2013.01); *E06B 2009/002* (2013.01)

(58) Field of Classification Search

CPC ..... E06B 9/02; E06B 9/0692; E06B 9/06; E06B 9/0676; E06B 9/04; B60P 7/00; B60P 7/15; B25B 5/06

USPC ..... 160/217, 222, 215, 351, 377, 372, 371; 403/91, 93; 49/463, 465, 55, 57

See application file for complete search history.

(56) References Cited

U.S. PATENT DOCUMENTS

| | | | |
|---|---|---|---|
| 3,758,100 | A | 9/1973 | Taylor et al. |
| 4,062,322 | A | 12/1977 | Dormehl |
| 4,294,196 | A | 10/1981 | Larsen |
| 4,492,263 | A | 1/1985 | Gebhard |
| 4,567,851 | A | 2/1986 | Larsen |
| 4,787,174 | A | 11/1988 | Brown |
| 4,926,722 | A | 5/1990 | Sorensen et al. |

(Continued)

OTHER PUBLICATIONS

Evenflo "Crosstown Gate Dunes"; 2 pages; 2008; www.evenflow.com/product.

*Primary Examiner* — Katherine Mitchell
*Assistant Examiner* — Jeremy Ramsey
(74) *Attorney, Agent, or Firm* — Lempia Summerfield Katz LLC

(57) ABSTRACT

A safety gate has a frame with spaced apart top and bottom assemblies and spaced apart side assemblies in a deployed configuration. The top and bottom assembly length is extendable and retractable between the opposed side assemblies. A flexible barrier is connected to the frame. A one-way jack mechanism can be carried on each of the top and bottom assemblies. The length of the assemblies can be extended without actuating the jack mechanisms to adjust the frame to nearly fit a space between two surfaces. The jack mechanisms, when actuated, incrementally further extend the top and bottom assemblies so the frame interferingly fits between the two surfaces under compression. The frame can be reconfigurable between a compact configuration and the deployed configuration. The side assemblies can include latches that lock the frame in the deployed configuration.

22 Claims, 16 Drawing Sheets

(56) References Cited

U.S. PATENT DOCUMENTS

| | | | | |
|---|---|---|---|---|
| 5,005,449 | A | 4/1991 | Sorensen et al. | |
| 5,009,134 | A | 4/1991 | Sorensen et al. | |
| 5,022,137 | A | 6/1991 | Sorensen et al. | |
| D320,919 | S | 10/1991 | Sorensen | |
| 5,060,421 | A | 10/1991 | Castelli | |
| 5,094,131 | A | 3/1992 | Sorensen et al. | |
| 5,102,103 | A | 4/1992 | Putnam | |
| D328,846 | S | 8/1992 | Sorensen | |
| 5,152,508 | A | 10/1992 | Fish | |
| 5,170,682 | A | 12/1992 | Sorensen et al. | |
| D333,602 | S | 3/1993 | Gatzemeyer et al. | |
| 5,197,360 | A * | 3/1993 | Wooster, Jr. | 81/487 |
| 5,222,420 | A | 6/1993 | Sorensen et al. | |
| 5,499,800 | A | 3/1996 | Albin | |
| 5,638,885 | A * | 6/1997 | Freese et al. | 160/371 |
| 5,657,809 | A * | 8/1997 | Longoria et al. | 160/369 |
| 5,660,144 | A | 8/1997 | Venti | |
| 5,664,371 | A | 9/1997 | Berliner | |
| 5,704,164 | A * | 1/1998 | Huang | 49/55 |
| 5,826,310 | A | 10/1998 | Hobday | |
| 5,860,250 | A | 1/1999 | Hill et al. | |
| 5,906,068 | A | 5/1999 | Bode | |
| 5,906,069 | A | 5/1999 | Berliner | |
| 5,927,011 | A | 7/1999 | Sickenius | |
| 6,016,629 | A | 1/2000 | Sylvester et al. | |
| 6,098,750 | A | 8/2000 | Reynolds et al. | |
| 6,112,460 | A | 9/2000 | Wagnitz | |
| 6,113,085 | A | 9/2000 | Lindenthal et al. | |
| 6,119,754 | A | 9/2000 | Okonsky | |
| 6,152,434 | A * | 11/2000 | Gluck | 269/6 |
| 6,161,334 | A | 12/2000 | Goodin | |
| 6,178,694 | B1 | 1/2001 | Wagnitz | |
| 6,190,082 | B1 | 2/2001 | Butterfield | |
| 6,244,221 | B1 | 6/2001 | Kleinsasser | |
| 6,367,787 | B1 | 4/2002 | Poole et al. | |
| 6,368,037 | B1 * | 4/2002 | Oliviero et al. | 410/151 |
| 6,370,823 | B1 | 4/2002 | Andersen | |
| 6,375,165 | B1 | 4/2002 | Sherratt et al. | |
| 6,412,767 | B1 | 7/2002 | Beckmann et al. | |
| 6,474,021 | B2 * | 11/2002 | Homeyer | 49/57 |
| 6,655,087 | B2 | 12/2003 | Andersen | |
| 6,711,857 | B1 | 3/2004 | Wagnitz et al. | |
| 6,733,220 | B2 * | 5/2004 | Brown et al. | 410/151 |
| 6,834,618 | B2 | 12/2004 | Pickin et al. | |
| 6,860,179 | B2 | 3/2005 | Hopper et al. | |
| 7,090,209 | B1 | 8/2006 | Rowlay | |
| 7,131,235 | B2 | 11/2006 | Hicks | |
| 7,131,642 | B1 | 11/2006 | Rowlay et al. | |
| 7,159,858 | B2 | 1/2007 | Ben-Gigi | |
| 7,178,792 | B2 | 2/2007 | Monahan et al. | |
| D545,161 | S | 6/2007 | Ranieri | |
| D545,162 | S | 6/2007 | Ranieri | |
| D557,582 | S | 12/2007 | Murray et al. | |
| 7,325,797 | B2 | 2/2008 | Kloepfer et al. | |
| 7,389,978 | B2 | 6/2008 | Rowlay et al. | |
| 7,422,048 | B2 * | 9/2008 | Andersen | 160/377 |
| 7,481,471 | B2 | 1/2009 | Andersen et al. | |
| 7,568,449 | B2 | 8/2009 | Hirokawa et al. | |
| 7,641,183 | B2 | 1/2010 | Fuller et al. | |
| 7,651,078 | B2 | 1/2010 | Geier et al. | |
| 7,699,297 | B2 | 4/2010 | Cicenas et al. | |
| 7,716,874 | B2 | 5/2010 | Ventrola | |
| 7,735,813 | B2 | 6/2010 | Geier et al. | |
| 7,739,983 | B2 | 6/2010 | Hirokawa et al. | |
| 7,815,175 | B2 | 10/2010 | Cicenas et al. | |
| 8,459,679 | B2 * | 6/2013 | Jessie, Jr. | 280/282 |
| 2006/0027798 | A1 | 2/2006 | Winston | |
| 2006/0185081 | A1 | 8/2006 | Peer | |
| 2006/0260195 | A1 | 11/2006 | Witman et al. | |
| 2007/0138724 | A1 | 6/2007 | Gibbons et al. | |
| 2007/0176342 | A1 | 8/2007 | Noniewicz | |
| 2007/0194510 | A1 | 8/2007 | Geler et al. | |
| 2007/0294944 | A1 | 12/2007 | Pedersen | |
| 2008/0029944 | A1 | 2/2008 | Avalani | |
| 2008/0110413 | A1 | 5/2008 | Kobayashi et al. | |
| 2008/0179801 | A1 | 7/2008 | Geier et al. | |
| 2008/0185566 | A1 | 8/2008 | Flannery | |
| 2008/0191497 | A1 | 8/2008 | Mayo et al. | |
| 2008/0246203 | A1 | 10/2008 | Alexander | |
| 2008/0265233 | A1 | 10/2008 | Flannery | |
| 2010/0013133 | A1 | 1/2010 | Strauss | |
| 2010/0013136 | A1 | 1/2010 | Strauss et al. | |
| 2010/0019429 | A1 | 1/2010 | Simon | |
| 2010/0084798 | A1 | 4/2010 | Geier et al. | |
| 2010/0276860 | A1 | 11/2010 | Geier et al. | |

* cited by examiner

SAFETY GATE

RELATED APPLICATION DATA

This patent is related to and claims priority benefit of U.S. provisional patent application Ser. No. 61/444,966 filed Feb. 21, 2011 and entitled "Safety Gate." The entire contents of this prior filed provisional application are hereby incorporated by reference herein.

BACKGROUND

1. Field of the Disclosure

The present disclosure is generally directed to safety gates and, more particularly, to a safety gate with a clamp adjustment mechanism for extending the length or width of the safety gate and securely installing the safety gate in an opening.

2. Description of Related Art

Safety gates for preventing children and pets from accessing specific areas in a home or dwelling, such as a stairwell or a particular doorway, are well known in the art. Conventional safety gates, such as the one disclosed in expired U.S. Pat. No. 4,492,263, generally have overlapping panels and tubes that are widthwise slidably adjustable to extend the width of a particular opening. The tubes or panels have end caps or feet that engage the surfaces of the opening or doorway when the gate is installed. The end caps or feet are typically installed under compression between the surfaces of the doorway or opening to secure the safety gate in place.

Conventional safety gates tend to be rather bulky and have a rudimentary adjustment system with relatively large adjustment increments. As a result, safety gates can be difficult to transport and/or store and can be time consuming and frustrating to set-up. Such safety gates can also be difficult to adjust to precisely fit a given opening. Often, the gate can be adjusted incrementally to fit different opening sizes. However, the adjustment sizes can be limited by the relatively large gap between available size increments. The actual opening size to be barricaded often falls between two adjustment increments. Thus, the gate may be under too much, which may damage the surfaces of the opening, or under too little compression and thus not fully secured in place when installed.

Clamp mechanisms are also well known in the art. Conventional clamp mechanisms, such as the one disclosed in expired U.S. Pat. No. 5,009,134, generally include a fixed jaw and a movable jaw. When the clamp mechanism is actuated, the movable jaw moves towards the fixed jaw to clamp an item between the jaws. A squeezing action on a grip, handle, or actuator is typically employed to allow for small incremental adjustment of the clamp jaw spacing relative to one another.

SUMMARY

In one example according to the teachings of the present invention, a safety gate has a frame with top and bottom assemblies spaced apart in a vertical direction and opposed side assemblies spaced apart in a horizontal direction. A length of the top and bottom assemblies is extendable and retractable to adjust a width of the frame between the opposed side assemblies. A flexible barrier is connected to and supported by the frame. An adjustment or jack mechanism is carried on each of the top and bottom assemblies. The length of the top and bottom assemblies can be extended without actuating the adjustment or jack mechanisms to adjust the frame to a desired width to nearly fit a space between two surfaces. The adjustment or jack mechanisms, when actuated, can then incrementally further extend the length of the top and bottom assemblies such that the frame interferingly fits between the two surfaces under compression.

In one example, the barrier can cover a substantial portion of an opening in the frame within the top, bottom, and opposed side assemblies.

In one example, the barrier can be coupled to the top and bottom assemblies and to the opposed side assemblies and can be extendable and retractable as the width of the frame is adjusted.

In one example, the length of the top or bottom assembly can be adjusted completely independent of the other.

In one example, each adjustment or jack mechanism can have a squeezable lever that, when squeezed and released, incrementally further extends the length of the respective top or bottom assembly.

In one example, the top and bottom assemblies each can have a fixed segment and an adjustable segment telescopically slidable relative to the fixed segment.

In one example, each adjustment or jack mechanism can be connected to a respective fixed segment of the top and bottom assemblies, whereby actuating the adjustment or jack mechanism incrementally further extends an adjustable segment relative to the fixed segment.

In one example, each adjustment or jack mechanism has a squeezable lever that, when squeezed and released, incrementally further extends an adjustable segment of the respective top and bottom assemblies.

In one example, each adjustment or jack mechanism can prevent an adjustable segment from being retracted toward a respective fixed segment of the top and bottom assemblies unless the adjustment or jack mechanism is released.

In one example, each adjustment or jack mechanism has a release mechanism actuable to release a respective adjustable segment so as to be retractable toward a fixed segment of the corresponding top and bottom assemblies.

In one example, the frame can be foldable to a compact configuration with the top and bottom assemblies positioned closely adjacent and generally parallel to one another and with the opposed side assemblies folded therebetween.

In one example, the frame can be reconfigurable from the deployed configuration to a compact configuration. The side assemblies can each having a latch that locks the frame in the deployed configuration and that can be unlatched to allow the frame to fold to the compact configuration.

In one example according to the teachings of the present invention, a safety gate has a frame with top and bottom assemblies and opposed side assemblies. The frame is reconfigurable between a compact configuration and a deployed configuration. A flexible barrier is connected to and supported by the frame. A one-way jack mechanism is carried on each of the top and bottom assemblies. The jack mechanisms, when actuated, incrementally extend a length of the top and bottom assemblies such that the frame can interferingly fit between two surfaces under compression in the deployed configuration. In the compact configuration, the top and bottom assemblies are closely spaced and generally parallel to one another and the opposed side assemblies are folded between or adjacent the top and bottom assemblies.

In one example, the frame is generally rectangular in the deployed configuration. The frame can take on other shapes and configurations, depending on the shape and contour of the top, bottom, and side assemblies.

In one example, the barrier substantially covers the opening in the frame.

In one example, the opposed side assemblies can each have an upper and lower section connected to one another at a central hinge. The sections can be pivotable between an extended orientation or position relative to one another and a folded orientation or position relative to one another, corresponding to the deployed and folded configurations, respectively, of the frame.

In one example, each side assembly can have two sections connected by a central hinge or pivot hub. Each central hinge can have a latch configured to lock the respective side assembly in the extended orientation or position.

In one example, each side assembly can have two sections connected by a central hinge or pivot hub with a latch. Each latch can be selectively latched to lock the side assemblies in the extended orientation or position. Each latch can also be unlatched to permit the corresponding sections to pivot from an extended orientation to a folded orientation.

In one example, each side assembly can have a latch that can be selectively unlatched by pushing a corresponding pin, which unlocks respective upper and lower sections of the side assemblies. In one example, the pins are spring biased to a latched position.

In one example, each side assembly can have two sections connected by a central hinge or pivot hub. Each latch can have a hinge knuckle defined in part on an end of each of the two sections and a bore extending axially along the hinge knuckle and formed in part by each of the upper and lower sections. The bore can have differently shaped circumferential portions or regions spaced along its length. The latch can also have a latch pin within the bore. The latch pin can have differently shaped circumferential segments or parts spaced along its length. The latch pin can be axially movable between a latched position and an unlatched position within the latch bore. The differently shaped portions or regions and segments or parts can cooperate to permit relative rotation between the upper and lower sections of the side assemblies in an unlatched position and to prevent relative rotation between the upper and lower sections in a latched position. Each latch can also have a spring that biases the latch pins to the latched position.

In one example, each side assembly can have two sections connected by a central hinge or pivot hub. Each hinge can have a latch with a latch pin in a bore. Upon movement of the latch pins to a released or unlatched position, the pins can be held in the released or unlatched positions by misalignment of portions within the bore when the upper and lower sections are pivoted from the deployed configuration toward the compact configuration.

In one example, the length of the top and bottom assemblies can be extended without actuating the jack mechanisms in the deployed configuration to adjust the frame to a desired width to nearly fit a space between the two surfaces before actuating the jack mechanisms.

In one example, the barrier covers a substantial portion of the opening in the frame. The barrier can be folded up generally between the top and bottom assemblies in the compact configuration.

In one example according to the teachings of the present invention, a safety gate has a frame with top and bottom assemblies and opposed side assemblies. The frame is reconfigurable between a compact configuration with the side assemblies in a folded orientation and a deployed configuration with the side assemblies in an extended orientation. A central hinge pivotally connects an upper section and a lower section on each of the opposed side assemblies. A flexible barrier is connected to and supported by the frame. A latch is provided at each of the central hinges. The latches lock the central hinges with the side assemblies in the extended orientation and the frame in the deployed configuration. Each central hinge is unlocked by pushing a pin to an unlatched position allowing the side assemblies to pivot to the folded orientation and the frame to fold to the compact configuration.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

It is the aim of the present invention to provide a safety gate that is safe and secure when installed, is easy to install, is easy to use, and is easy to transport and store. A safety gate is disclosed herein that, when deployed, can be positioned and removably secured in a doorway or other opening between opposed surfaces, such as a doorframe, hallway walls, or stairwell entrance or exit walls. When installed, the disclosed safety gate serves as a barrier to inhibit pets and children from accessing certain rooms, spaces, or floors of a home or dwelling, as desired. The disclosed safety gate employs a frame that is adjustable to allow the gate to be freely expanded and pulled open to a desired length or width to loosely fit within an opening.

The disclosed safety gate has adjustment or jack mechanisms that can be used to micro-adjust the gate frame in fine or small increments to the length or width necessary to secure the gate in place when installed. The micro-adjustment process is easy and intuitive. By setting up the gate to its approximate size and actuating the jack mechanisms a few times or less, the safety gate can be easily yet securely set-up and installed. When not in use, the safety gate can be conveniently and easily folded or collapsed from the deployed or in-use configuration to a compact storage configuration. As a result, unlike prior art safety gates, the disclosed safety gate is easy to transport and store. These and other objects, features, and advantages of the present invention will become apparent upon reading this disclosure.

Figure 1:
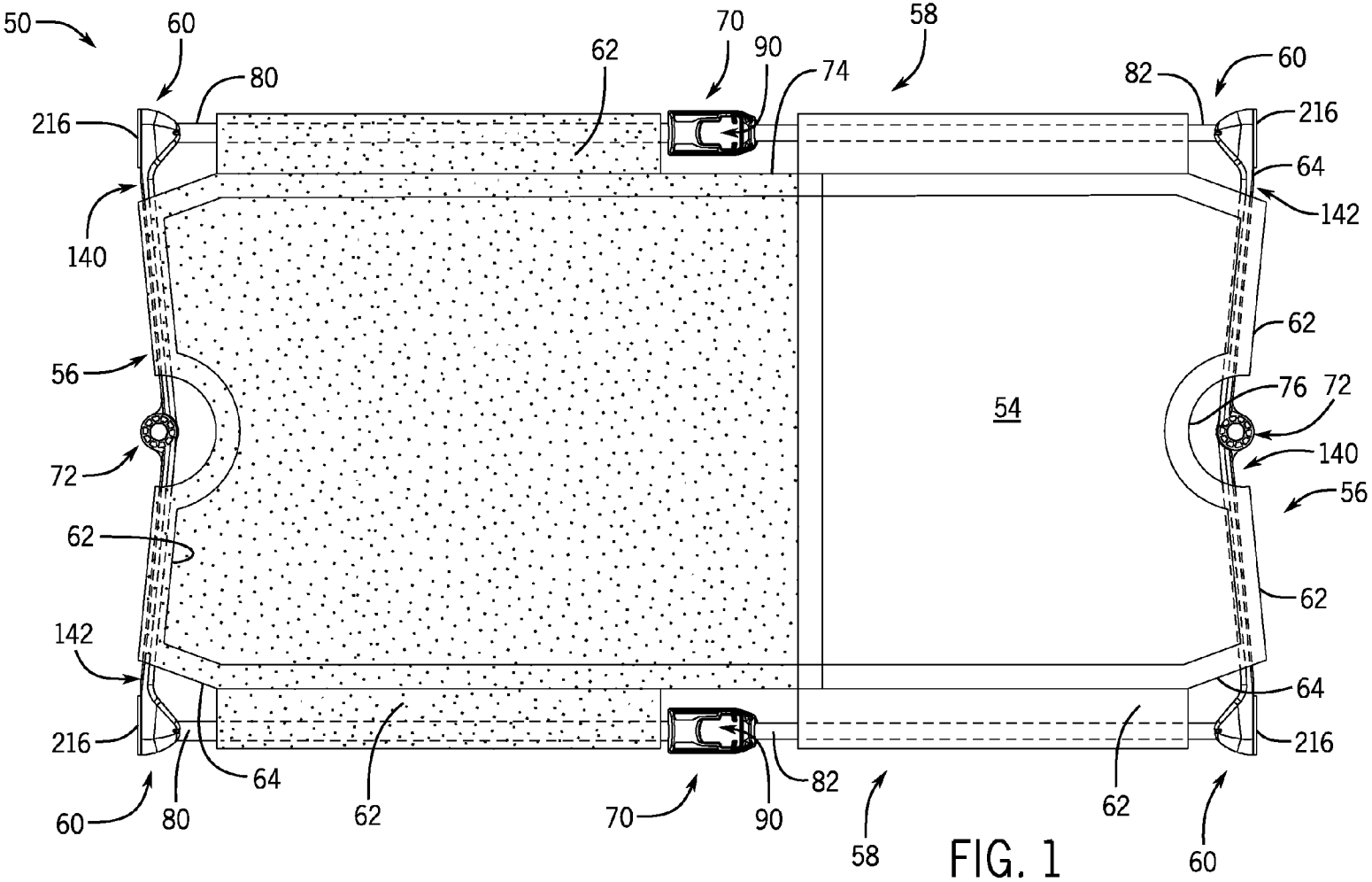
FIG. 1 shows a rear view of one example of a safety gate constructed in accordance with the teachings of the present invention and in an extended and deployed configuration.
Figure 2B:
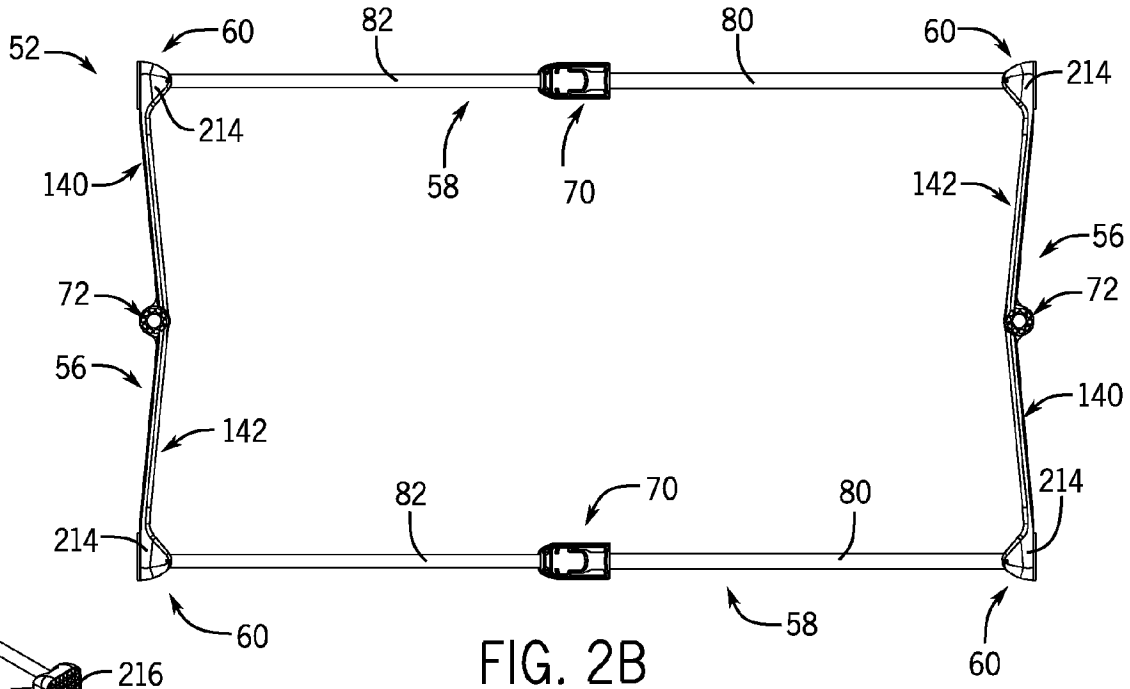
FIGS. 2A and 2B show a perspective front view and a front view, respectively, of the frame of the safety gate shown in FIG. 1.
Figure 2A:
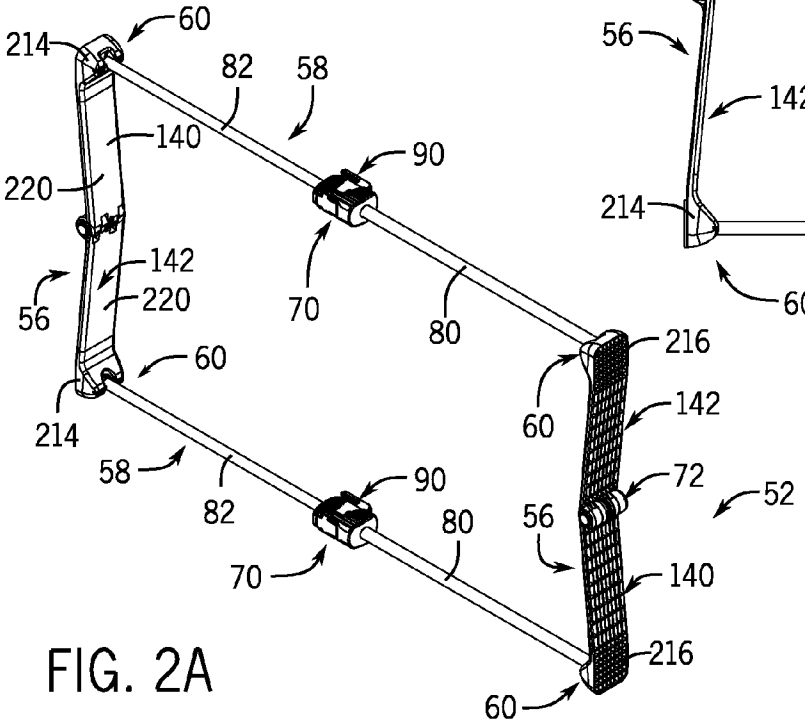

Turning now to the drawings, FIG. 1 shows a safety gate 50 constructed in accordance with the teachings of the present invention. In this example, the safety gate 50 has a frame 52 that carries and supports a barrier 54. The frame 52 is shown in FIGS. 2A and 2B and generally has two opposed side assemblies, i.e., left and right side assemblies, 56, and opposed top and bottom assemblies 58. The side assemblies 56 are spaced apart in a horizontal direction and generally oppose one another on opposite sides of the frame 52. The side assemblies 56 define the terminal ends or side to side boundaries of the safety gate 50. The top and bottom assemblies 58 are spaced apart in a vertical direction and generally oppose one another. The top and bottom assemblies 58 define the upper and lower boundaries of the safety gate 50. The free ends of the top and bottom assemblies 58 are each connected at respective pivot joints 60 to the side assemblies 56. The pivot joints 60 are positioned near their corresponding upper and lower ends on the side assemblies 56 in this example.

The side assemblies 56 in the disclosed example are essentially identical to one another or at most minor images of one another. Likewise, the top and bottom assemblies 58 are essentially identical to one another or at most minor images of one another. Thus, only one of the side assemblies 56 and only the top assembly 58 are described in substantial detail herein. Similarly, the pivot joints 60 in the disclosed example are essentially identical in construction to one another or at most minor images or one another as well. Therefore, only one of the pivot joints 60 is described in substantial detail herein.

Figure 3B:
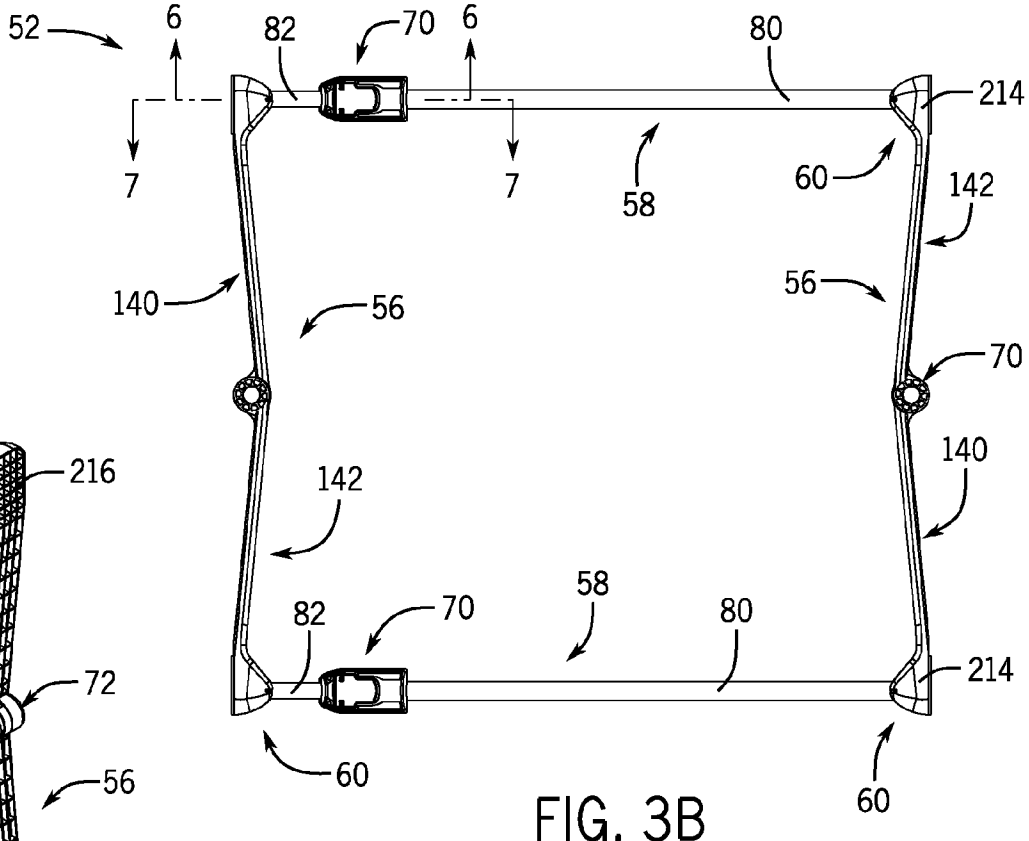
FIGS. 3A and 3B show a perspective front view and a front view, respectively, of the frame shown in FIG. 1, but in a widthwise retracted and deployed configuration.
Figure 3A:
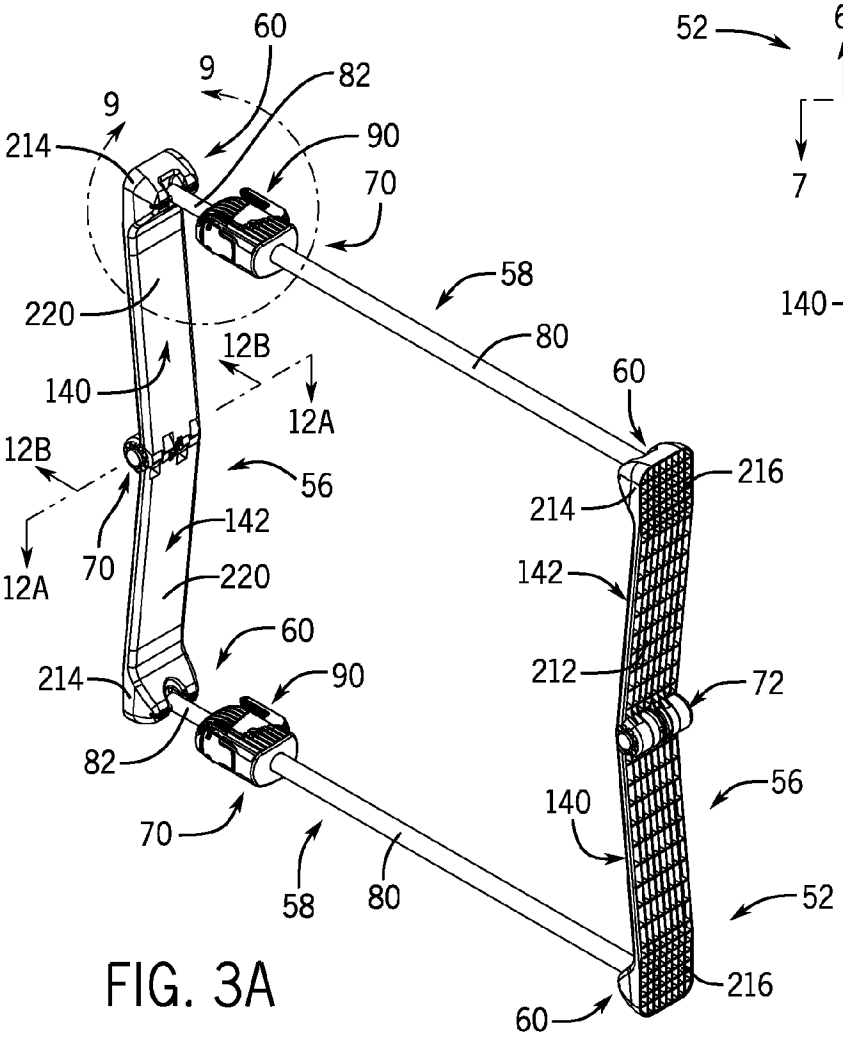
Figure 4A:
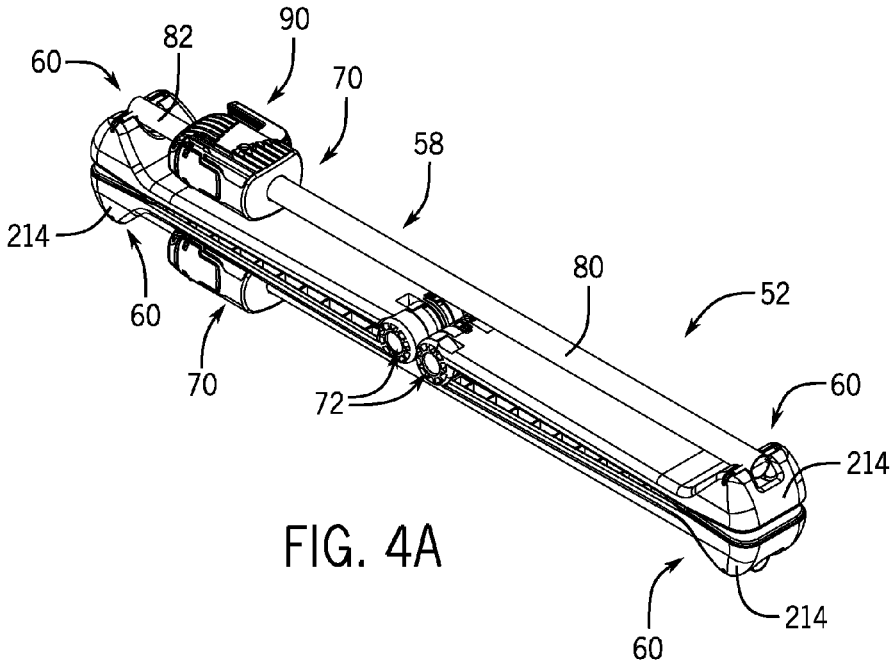
FIGS. 4A and 4B show a perspective front view and a front view, respectively, of the frame shown in FIGS. 3A and 3B, but in a folded, compact configuration.
Figure 4B:
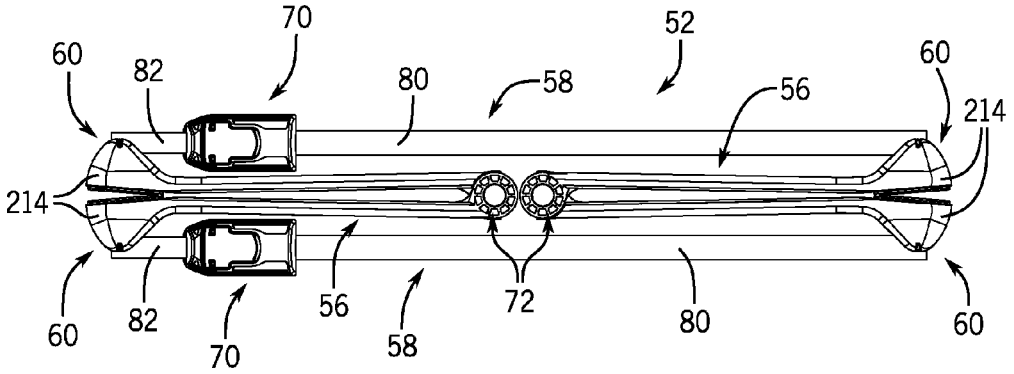

The frame 52 is generally widthwise extendable and retractable to fit different sized openings. The safety gate 50 and frame 52 are shown in an extended and deployed configuration in FIGS. 1, 2A, and 2B and in a retracted but deployed configuration in FIGS. 3A and 3B. The top and bottom assemblies 58, as described in greater detail below, are lengthwise extendable and retractable in order to render the safety gate 50 widthwise extendable and retractable. The safety gate 50 and frame 52 are also movable between a collapsed or folded configuration, as shown in FIGS. 4A and 4B and the retracted in-use or deployed configuration as shown in FIGS. 3A and 3B. The safety gate 50 could also be folded from the extended, deployed configuration of FIGS. 2A and 2B, if desired. The widthwise adjustment function, folding function, and corresponding parts and characteristics of the frame 52 are described in greater detail below.

The barrier 54 is a flexible material and/or an elastic material that can fold along with the frame 52. In the deployed configuration, the side assemblies 56 and top and bottom assemblies 58 of the frame 52 form a rectangle-like shape as shown in FIG. 1, although other shapes and contours are certainly possible. The frame 52 is shown in FIGS. 2B and 3B in the deployed configuration, but without the barrier 54. The opposed side assemblies 56 and the top and bottom assemblies 58 together generally define an opening within and between the assemblies 56, 58 of the frame 52. The barrier 54 is connected to the various assemblies of the frame and covers a substantial majority of this opening in the deployed configuration. The barrier 54 can be elastic or stretchable in order to increase in width as the safety gate 50 is extended. Alternatively, the barrier 54 can include sufficient material to achieve the most extended configuration of which the safety gate 50 is capable and can fold up as needed in any less than fully extended configuration.

The barrier 54 can be a stretchable or elastic fabric, mesh, sheet, or other such material. Alternatively, the barrier 54 can instead be a non-stretchable or inelastic fabric, mesh, sheet, or other suitable material that is sufficiently flexible to be capable of folding up when the frame 52 is folded. The barrier can also be formed of one homogeneous material or from two or more different materials, material layers, or the like. The barrier 54 could be formed in two side-by-side sections of different materials. As described below, one side of the safety gate 50 has a fixed width or length defining the minimum opening size into which the gate will fit. The other side of the safety gate 50 is extendable and retractable to change the size of the gate. The extendable side of the safety gate 50 could include a limp, highly flexible, foldable, or compressible fabric, such as a mesh material. This can allow the gate to achieve a relatively small, compact minimum package size in the folded or compact configuration. The fixed side of the safety gate 50 could utilize a less flexible, stiffer, more course material, such as a solid fabric. This material could permit the printing of required warning labels/instructions directly on the fabric or permit sewing directly to the material separate patches or swatches with the labels/instructions thereon. In the deployed configuration, the material of the barrier 54, regardless of its make-up, serves as the barrier of the safety gate 50 that inhibits children or pets from passing to the other side of the gate, as is known in the art.

As depicted in FIG. 1, the perimeter edges of the barrier 54 can include sewn tunnels 62. The opposed side assemblies 56 and top and bottom assemblies 58 can be received through these tunnels 62 in order to attach the barrier 54 to the frame 52. The perimeter edges of the barrier 54 can also include notches or cutouts 64 that are adjacent the location of the four pivot joints 60. The cutouts 64 allow clearance between the joints 60 and the barrier 54. The cutouts 64 prevent pinching of the barrier material at the joints 60 and permit proper function of the joints when the gate is deployed, being folded and unfolded, and/or in the compact configuration.

Also as shown in FIGS. 1, 2A, and 2B, the safety gate 50 generally has two adjustment or jack mechanisms 70, each carried on a corresponding one of the top and bottom assemblies 58 of the frame 52. As described herein, the jack mechanisms 70 are utilized to incrementally adjust the width of the gate 50 between the side assemblies 56. Each of the side assemblies 56 also has a central pivot hub 72. As described below, the pivot hubs 72 are configured to allow the corresponding side assemblies 56 to fold or collapse and also to lock the side assemblies in their extended, i.e., deployed, position or orientation when the safety gate 50 is in the deployed configuration. Details of the pivot hubs 72 and the jack mechanisms 70 are described below. The barrier 54 also has cutouts 74, 76 in its perimeter edges that are positioned adjacent the jack mechanisms 70 and the pivot hubs 72, respectively. The cutouts 74 and 76 are also provided to allow clearance between the respective jack mechanisms 70 or pivot hubs 72 and the barrier material. These cutouts 74, 76 also prevent pinching of the barrier material and permit proper function of and access to the jack mechanisms 70 and the pivot hub 72 during use.

Figure 5:
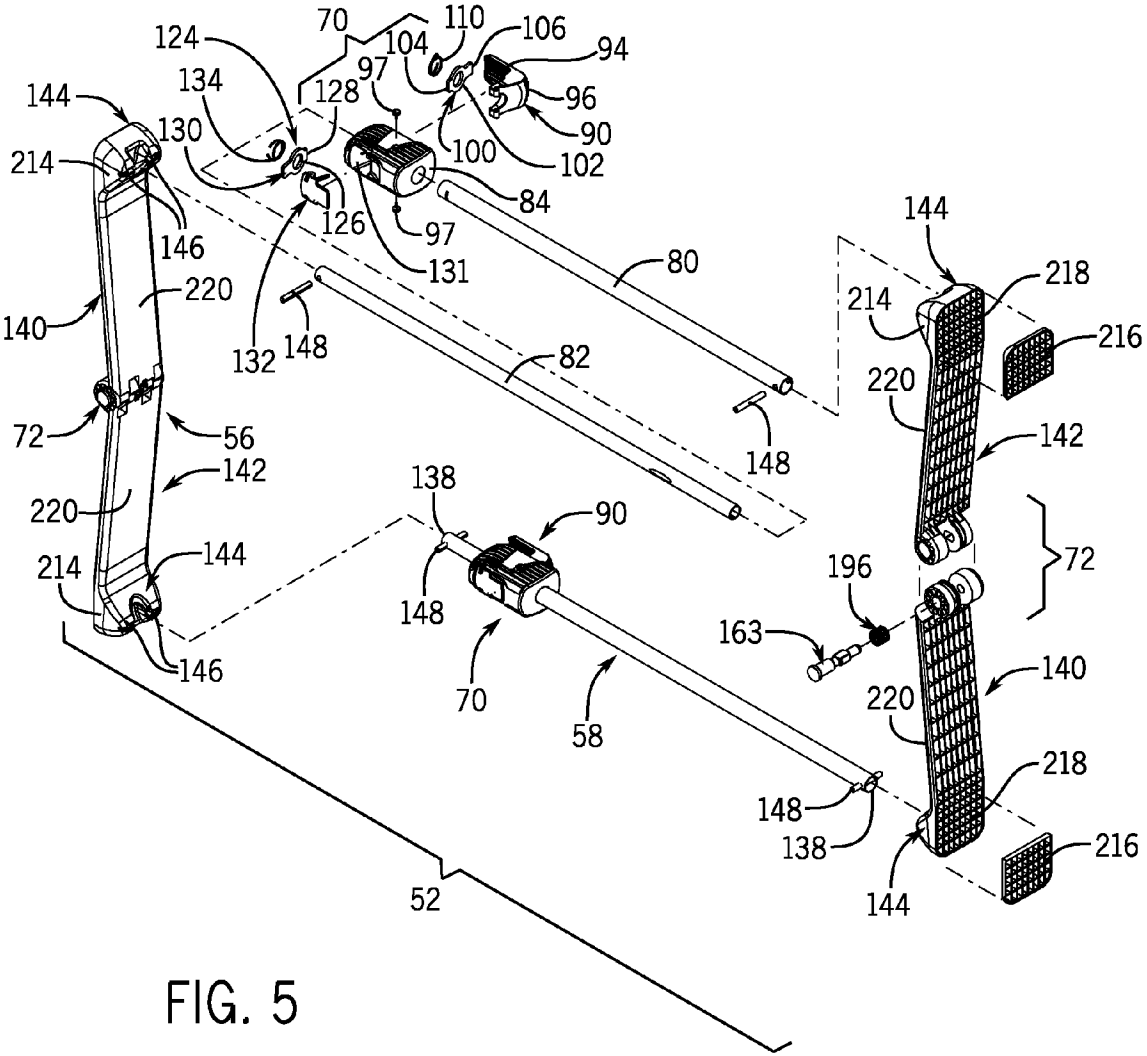
FIG. 5 shows an exploded view of the frame shown in FIG. 3A.

FIG. 5 is an exploded view of the safety gate 50 showing all of the primary components of the gate. Reference back to FIG. 5 when reading this disclosure can be helpful in understanding the invention. The construction and operation of the top assembly 56 is now described with reference to FIGS. 5-8, the bottom assembly having essentially the same construction. In this example, the top assembly 56 has two telescoping segments including a fixed segment 80 and an extendable or adjustable segment 82. In this example, both of the segments 80 and 82 are metal or steel tubes. In order to function properly in conjunction with the construction of the jack mechanism 70, the adjustable segment 82 telescopes within the fixed segment 80. The adjustable segment in this example can be a solid bar. The materials used to fabricate the segments can vary as long as the segments can function as intended.

Figure 6:
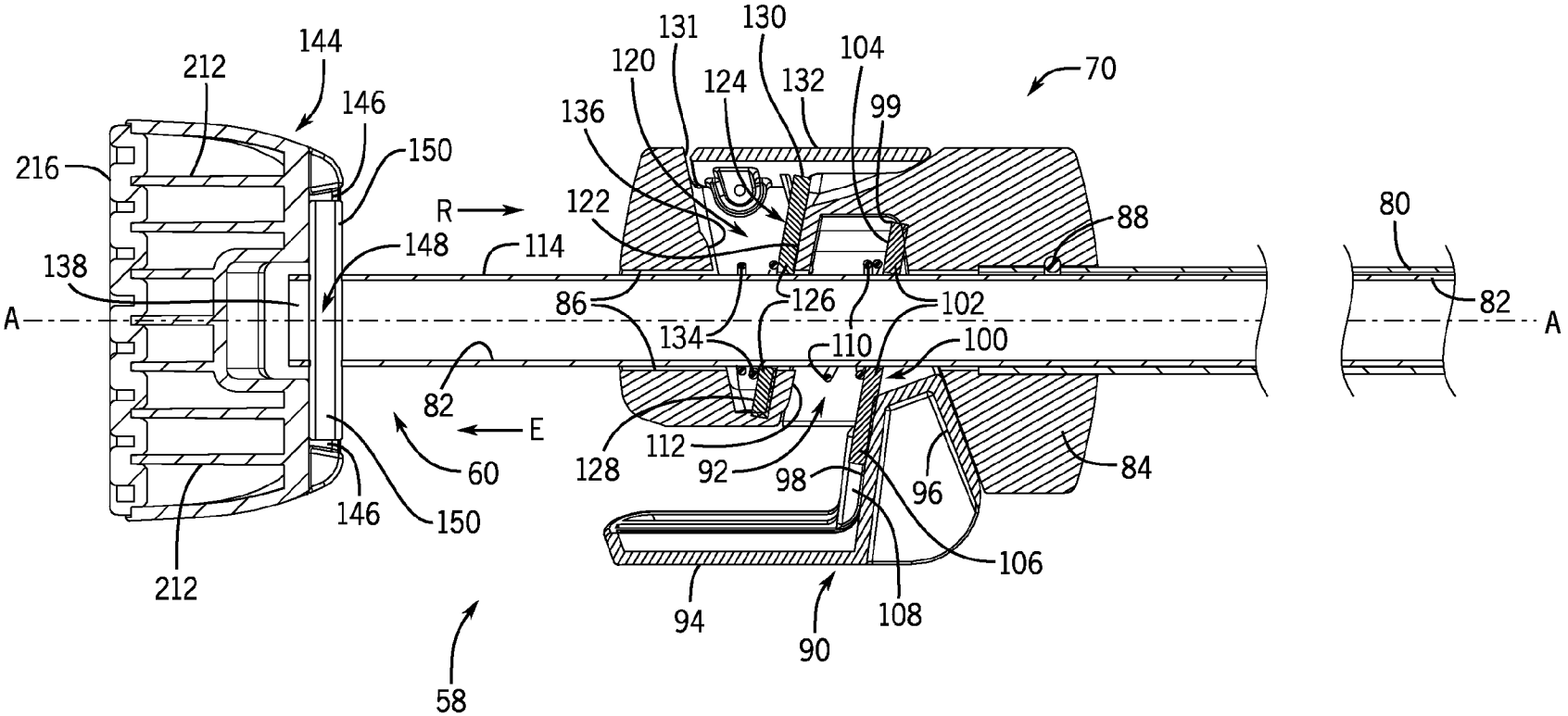
FIG. 6 shows a lengthwise cross-section taken along line 6-6 of the top assembly of the frame shown in FIG. 3B.

The jack mechanism 70 has a housing 84 with a bore 86 extending lengthwise through the housing. Both of the segments 80 and 82 extend at least partly through the bore. A fixing element 88 is shown in FIG. 6 and secures the housing 84 in position, both rotationally and longitudinally, on the fixed segment 80. The adjustable segment 82 is slidably received through the bore 86 and into the fixed segment 80. The fixing element 88 can take on any number of configurations and constructions, as long as it is suitable to retain the housing 84 affixed to the fixed segment 80. The fixing element 88 can be a protrusion, bushing, snap ring, VALCO ball, rivet, screw, or the like that is welded, affixed, installed, or otherwise formed on or attached to the outer surface of the fixed segment 80. The housing 84 and/or bore 86 can include a corresponding detent, hole, orifice, aperture, catch, or the like to capture the fixing element. The parts can be reversed relative to the housing and fixed segment as well. The adjustable segment 82 can slide relative to the fixed segment 80 and the housing 84.

The jack mechanism 70 has a lever 90 pivotally mounted partly over and partly within a first cavity 92 on one side of the housing 84. The lever 90 has an actuator or grip 94 that is spaced from and generally parallel to a surface of the housing 84. The lever 90 also has a body 96 connected to the grip 94. The body 96 is seated in the first cavity 92 and pivotally mounted therein. Pivot pins 97, as shown in FIG. 5, connect the lever 90 to the housing 84 and the lever is pivotable about the pins.

With reference to FIG. 6, a drive surface 98 of the body faces into the first cavity. A bearing surface 99 is defined by one cavity wall facing in the same direction as the drive surface 98, but near the blind bottom end of the first cavity 92. A drive plate 100 has a through-hole 102 and the adjustable segment 82 passes through the through-hole. The drive plate 100 has a pivoting end seated deep within the blind end of the first cavity 92 on a side of the adjustable segment 82 opposite the lever 90. The drive plate 100 also has a drive end 106 captured in the seat 108 under the base or proximal end of the grip 94 on the lever 90. One face of the drive plate 100 at the drive end 106 bears against the drive surface 98 on the lever body 96. The same face of the drive plate at the pivoting end 104 bears against the bearing surface 99 within the cavity. A spring 110 is concentric with the adjustable segment 82. One end of the spring bears against the exposed surface of the drive plate 100 and the opposite end of the spring bears against a fixed stop surface 112 within the first cavity opposite the bearing surface 99.

The lever 90 is shown in FIG. 6 in an at-rest or home position relative to the housing 84. In the home position, the drive plate 100 and through-hole 102 are sized and oriented so that the edge of the through-hole does not bite on the exterior surface 114 of the adjustable segment 82. Thus, the adjustable segment 82 would be cable of sliding in either direction, i.e., in the retracted direction of the arrow R and the extended direction of the arrow E. However, the drive plate 100 and thus the orientation of the through-hole are oriented at a non-perpendicular angle relative to the longitudinal axis A of the adjustable segment 82. This is so that very little movement of the lever 90 will impart incremental movement of the adjustable segment 82 as described below.

The housing 84 has a second cavity 120 formed in the side of the housing opposite the first cavity 92. The second cavity 120 has a brake wall 122 facing into the cavity. The brake wall 122 is oriented at a non-perpendicular angle relative to the axis A of the adjustable segment 82. A brake plate 124 is disposed in the second cavity 120 and bears against the brake wall 122 in a braking position as shown in FIG. 6. The brake plate 124 has a through-hole 126 and a pivoting end 128 seated at the blind end deep in the second cavity 120. The brake plate 124 also has a working end 130 positioned near the opening 131 into the cavity. A cover 132 is received over the opening into the second cavity 120 and is pivotally connected via a hinge 134 to the housing 84. The size of the through-hole 126 and the angle of the brake plate 124 in the braking position result in the edge of the through-hole 126 biting into the exterior surface 114 of the adjustable segment 82. The brake plate 124 in this orientation will prevent the adjustable segment 82 from being retracted in the direction of the arrow R into the fixed segment 80. A spring 134 is borne against the exposed surface of the brake plate 124 at one end and borne against a cavity wall 136 opposite the brake wall 122 in the second cavity 120 at its opposite end. The spring biases the brake plate 124 against the brake wall in the braking position.

According to one aspect of the invention, the safety gate 50 can be easily adjusted without actuating the jack mechanisms 70 to nearly fit a desired opening size. Then the safety gate 50 can be secured using the jack mechanisms 70. In a disclosed example, the adjustable segment 82 can be readily pulled in the direction of the arrow E to extract the adjustable segment and extend the length of the top assembly 56. When pulled in this direction, the brake plate 124 will pivot about the pivoting end 128 away from the brake wall against the bias force of the spring 134. The brake plate 124 and thus the through-hole 126 will then be more perpendicular to the axis A. Likewise, the pivoting end of the drive plate 100 will release from the bearing surface 99 in the first cavity. The drive end 106 will remain captured in the seat 108 under the lever grip 94 so that the drive plate 100 pivots about the drive end. The drive plate 100 and through-hole 102 will then become more perpendicular to the axis A. The edges of the through-holes 102 and 126 will release the surface 114 of the adjustable segment 82, allowing the segment to slide along the bore 86 in the direction of the arrow E.

When the adjustable segment is extended to a desired position in this manner, the spring 134 will return the brake plate 124 against the brake wall 122 in the second cavity. Likewise, the spring 110 will return the drive plate 100 back into contact with the bearing surface 99 in the first cavity 92. The edges of the through-hole 126 in the braking position will again bite against the surface 114 on the adjustable segment 82, preventing it from returning in the direction of the arrow R.

Figure 7:
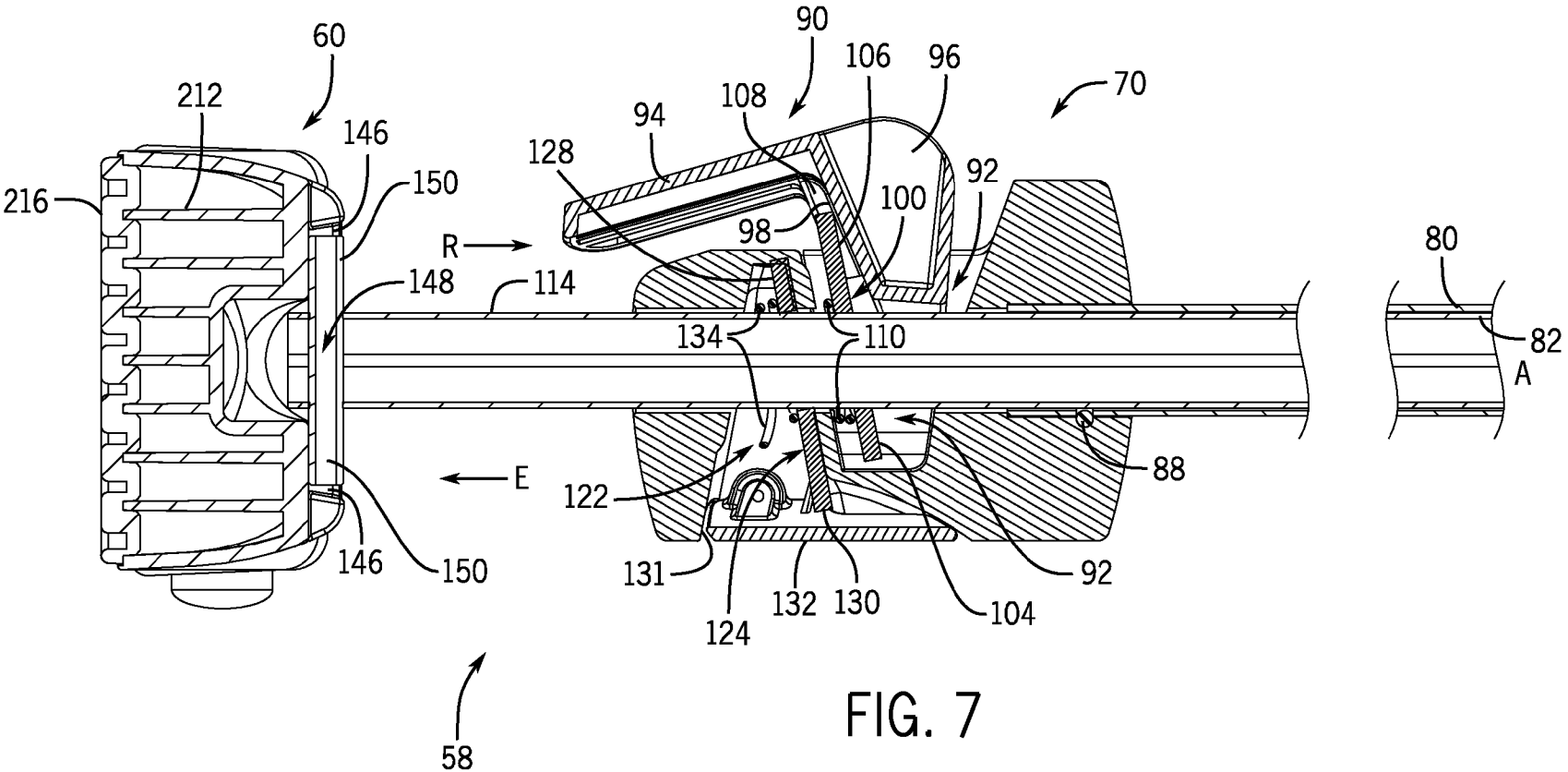
FIG. 7 shows a lengthwise cross-section taken along line 7-7 of the top assembly shown in FIG. 3B, but with the jack mechanism actuated.

The jack mechanism 70 can then be actuated by squeezing the lever 90 toward the housing 84 as shown in FIG. 7. This can be performed to incrementally further extend the adjustable segment 82 relative to the fixed segment 80 by fine or small increments. The grip 94 of the lever 90 can be squeezed toward the housing 84. When squeezed, the drive surface 98 on the lever body 96 pivots forward into the space of the first cavity 92. This forces the driven end 106 of the drive plate 100 forward. This also increases the relative angle of the drive plate 100 in comparison to the axis A. This causes the edges of the through-hole 106 to bite on the exterior surface 114 of the adjustable segment 82. As the lever is squeezed further, the drive plate 100 moves further into the first cavity 92, pushing the adjustable segment 82 in the direction of the arrow E. The pivoting end 104 of the drive plate 100 will release from the bearing surface 99 and move along with the adjustable segment 82 as the lever is squeezed further toward the body 84. The degree of lever actuation can control the amount of incremental travel created by one squeeze of the lever 90, limited by the space within the first cavity for movement of the drive plate 100. When the lever 90 is released, the spring 110 will return the drive plate 100 back toward the drive surface 98 and bearing surface 99, which in turn will return the lever to it at rest or home position. The brake plate 124 may move with and/or reorient slightly relative to the adjustable segment 82 to allow the segment to move with the drive plate 100. The spring 134 will return the brake plate into contact with the brake wall 122. The brake plate will then retain the adjustable segment 82 in this new incrementally extended position relative to the fixed segment 80.

The construction of the jack mechanism 70 allows the length of the top assembly 58 to be readily extended by pulling the adjustable segment 82 in the direction of the arrow E. The bottom assembly 58 can be extended in the same way. In this manner, the safety gate 50 can be easily extended to nearly fit the size of an opening. Once the safety gave 50 is placed within a desired opening and extended manually to nearly fit the opening size, the jack mechanisms 70 can then actuated to incrementally further extend the top and bottom assemblies 58 into contact with the surfaces of the opening. The lever 90 can be squeezed to secure the top and bottom assemblies 58 under compression against the surface of the opening. The top and bottom assemblies 58 can be adjusted independent of one another. The safety gate 50 can thus accommodate openings where the two surfaces are not square relative to one another.

Figure 8:
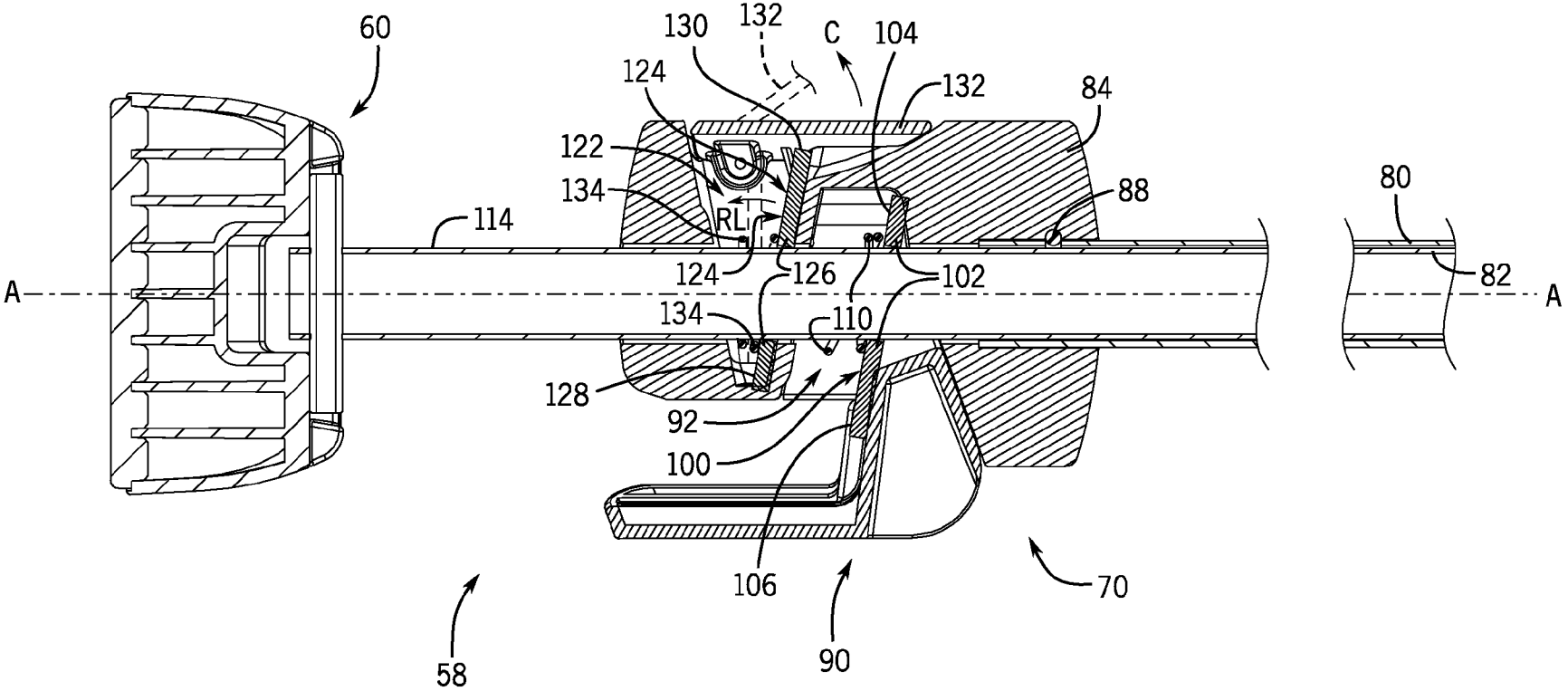
FIG. 8 shows the top assembly shown in FIG. 6 but with a phantom view of the release mechanism actuated.

The top segment 58 can be released by actuating the release mechanism as shown in FIG. 8. This is done by pivotally opening the cover 132, as shown in phantom in FIG. 8, on the jack mechanism 70 in the direction of the arrow C. This exposes the brake plate 124. The working end 130 is accessible in the opening 131 of the second cavity 120. The working end 130 of the brake plate 124 can then be pushed away from the braking wall 122 in the direction of the arrow RL. This is done against the bias of the spring 134 to reorient the brake plate 124 more perpendicular to the axis A as shown in phantom in FIG. 8. In doing so, the edges of the through-hole 126 release the exterior surface 114 of the adjustable segment 82. The adjustable segment 82 can then be retracted in the direction of the arrow R back into the bore 86 and the fixed segment 80. The bottom assembly 58 can be released in the same manner.

Figure 9:
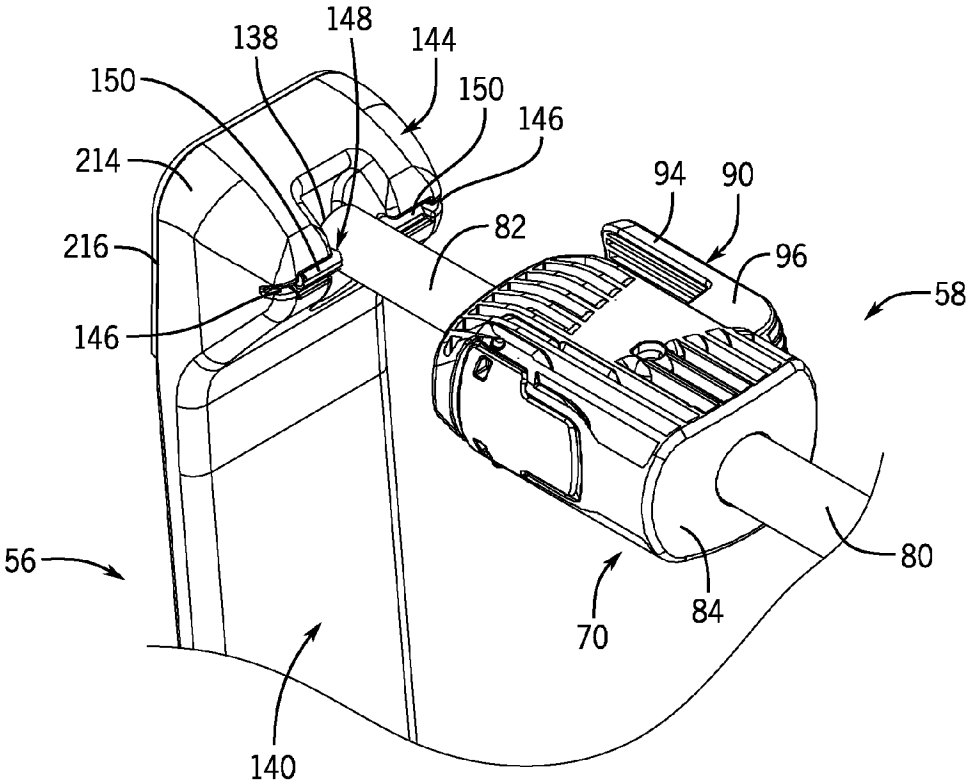
FIG. 9 shows a perspective view of one of the pivot joints of the frame shown in FIG. 3A.

According to another aspect of the invention, the frame 52 is easily foldable to the substantially compact configuration shown FIGS. 4A and 4B. With reference to FIGS. 5 and 9, the pivot joints 60 allow the free ends 138 of the top and bottom assemblies 58 to relative to the left and right side assemblies 56. Each side assembly 56 has an upper section 140 and a lower section 142. A portion of one of the joints 60 is carried near the respective upper and lower end of each upper and lower section 140, 142. In this example, a trunnion 144 is integrally molded with and protruding from an inner surface of the upper section 140. The lower section 142 has an identical trunnion and the right side assembly 56 has the same construction as the left side. The trunnion 144 defines a pair of open ended slots 146 facing inward. A pin 148 is connected to each free end 138 of the top and bottom assemblies 58. Each pin extends perpendicular to the axis A and has exposed portions 150 protruding outward on either side of the corresponding segment 80 or 82. In this example, the slots 146 are constructed so that the exposed portions 150 of the pin 148 snap into the slots on the trunnion 144. The pin 148 is then free to rotate within the slots 146 while remaining captured therein.

The configuration and construction of the joints 60 can vary from this example. There are a large number of pivot joint constructions that can be utilized within the spirit and scope of the present mention. In this example, the fixed pin 148, trunnion 144, and slots 146 provide a joint construction that is a relatively simple, inexpensive, and easy to assemble. The frame 52 can thus be relatively inexpensive to manufacture, require relatively few components, be relatively easy to assemble, and yet provide high-end performance and functionality. In one alternative example, the joints can be configured as ball and socket connections.

As shown in FIGS. 5, 10A, 10B, and 11, the proximal ends 160, 162 of the respective upper and lower sections 140, 142 on the left side assembly 56 are joined to one another, creating a hinge, i.e., the central pivot hub 72. A latch pin 163 is provided and performs multiple functions, one of which is to pivotally join the proximal ends 160, 162. In this example, the upper section 140 has two knuckle portions 164 that are spaced apart from one another and that extend lengthwise outward from the proximal end 160. The lower section 142 likewise has two knuckle portions 166 that are spaced apart from one another and extend lengthwise outward from the proximal end 162. The knuckle portions 164 and 166 are configured to nest between and among one another intermittently to form a hinge knuckle. The hinge knuckle defines a pin bore 168 extending through the knuckle portions 164 and 166 across a width of the hub 72.

Figure 10B:
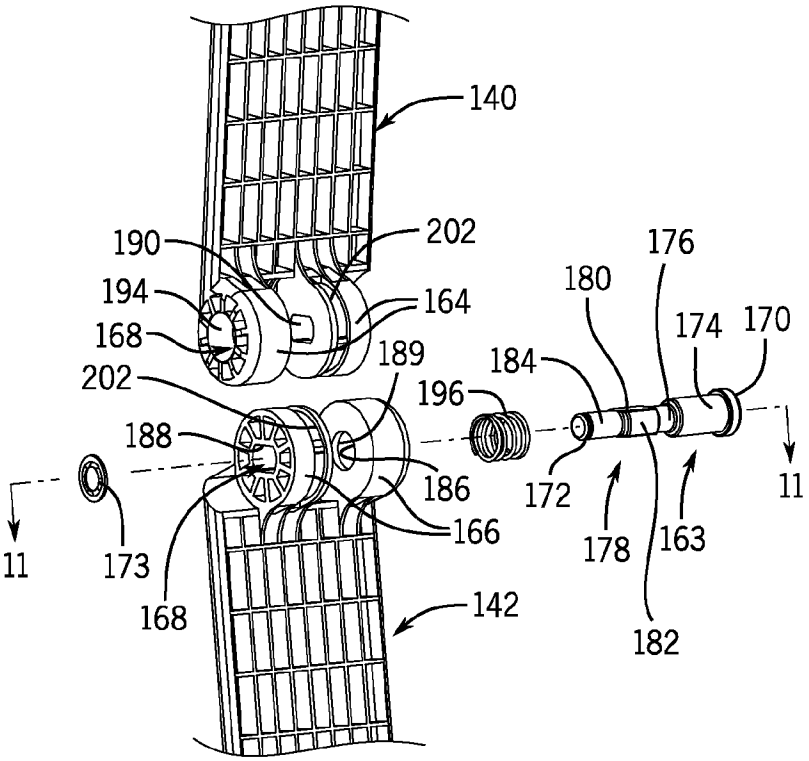
FIG. 10B show a reverse view of the left side assembly shown in FIG. 10A.
Figure 10A:
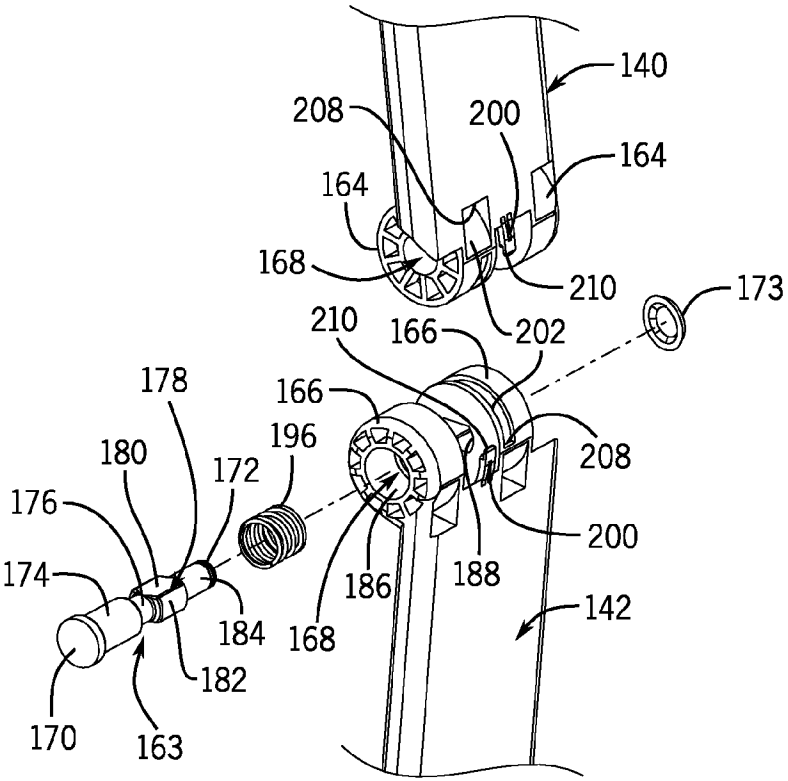
FIG. 10A shows a perspective exploded view of the pivot hub ends of the upper and lower sections of the left side assembly of the frame shown in FIGS. 2A and 3A.
Figure 11:
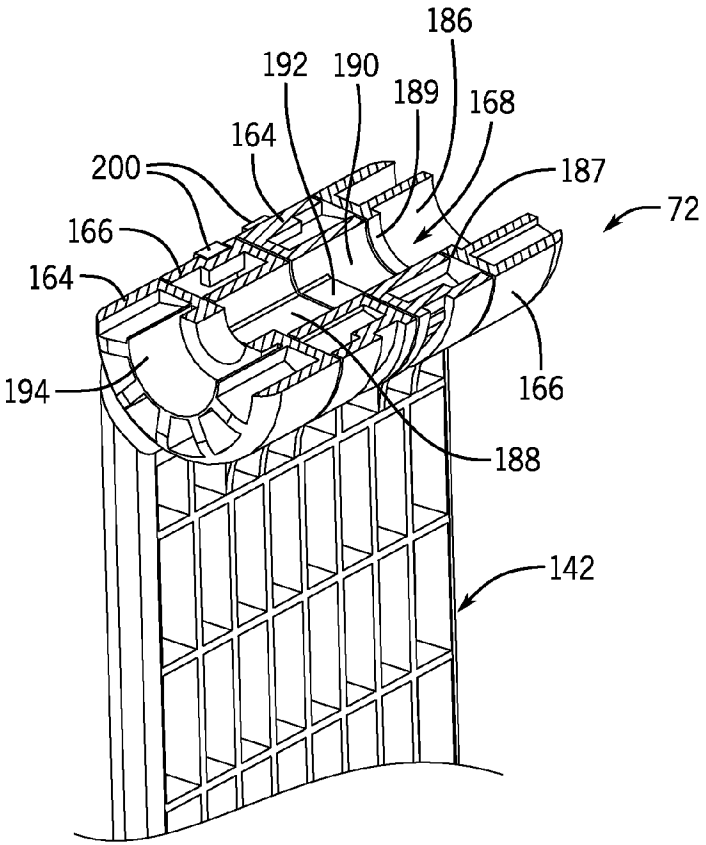
FIG. 11 shows a perspective cross-section taken along line 11-11 of the partly assembled upper and lower sections and pivot hub of the left side assembly shown in FIG. 10B.

As shown in FIGS. 10A and 10B, the latch pin 163 has a head 170 at one end and a groove 172 of the other end. The head 170 is sized to prevent the latch pin 163 from passing completely through the pin bore 168 in one direction. The groove 172 is provided to receive a one-way washer 173, snap ring, C-clip, or the like for retaining the other end of the pin 163 and preventing the pin from passing completely through the bore in a reverse direction. The latch pin 163 defines the axis of the pivot hub 72 and is received through the pin bore 168 including all four of the knuckle portions 164 and 166. The upper and lower sections 140, 142 are capable of pivoting relative to one another about the latch pin 163 between the deployed and compact configurations.

The latch pin 163 has a cylindrical first part 174 adjacent the head 170. The latch pin 163 has a cylindrical intermediate part 176 adjacent the first part 174. The intermediate part 176 has a smaller diameter than the first part 174. The latch pin 163 has a non-circular, shaped, keyed part 178 adjacent the second part 176. The keyed part 178 has a pair of opposed flat segments 180 and a pair of opposed bearing segments 182 offset 90° relative to the flat segments 180 circumferentially around the latch pin 163. The bearing segments 182 are of about the same curvature and diameter as the first part 174 on the latch pin 163. The flat segments 180 have a lesser diameter across the pin thereat. The latch pin 163 also has an end part 184 at the end of the pin opposite the head 170 and first part 174. The end part 184 is cylindrical, but of a smaller diameter than the first part 174. The groove 172 is formed in the surface of the end part 184 near the tip of the latch pin 163. Thus, the latch pin 163 has a number of differently shaped regions or segments over its length.

The pin bore 168 likewise has a number of differently shaped portions or segments over its length as well. With reference to FIGS. 10A, 10B, and 1, the pin bore 168 on the left side assembly 56 has a relatively large diameter cylindrical entry region 186 formed in one of the knuckle portions 166 on the lower section 142. The entry region 186 terminates at a shoulder 187 protruding radially inward. The shoulder defines an opening 189 of a smaller diameter than the entry region 186. The other knuckle portion 166 on the lower section 142 has a non-circular, shaped, keyed region 188 having a configuration to match that of the keyed part 178 on the pin 163, including the flat segments 180 and bearing segments 182. The intervening knuckle portion 164 of the upper section 140 between the knuckle portions 166 has a split bore with two differently shaped portions. One of the portions is a relief portion 190 that lies adjacent the shoulder 187 of the entry region 186. The diameter of the relief portion 190 is about the same as the diameter of the opening 189 through the shoulder 187. The other of the portions is a non-cylindrical, shaped, keyed portion 192. The keyed portion 192 is shaped to match that of the keyed region 188 in the adjacent knuckle portion 166. A cylindrical end region 194 is formed in the other knuckle portion 166 that defines the end of the pin bore 168 opposite the entry region 186.

Figure 12B:
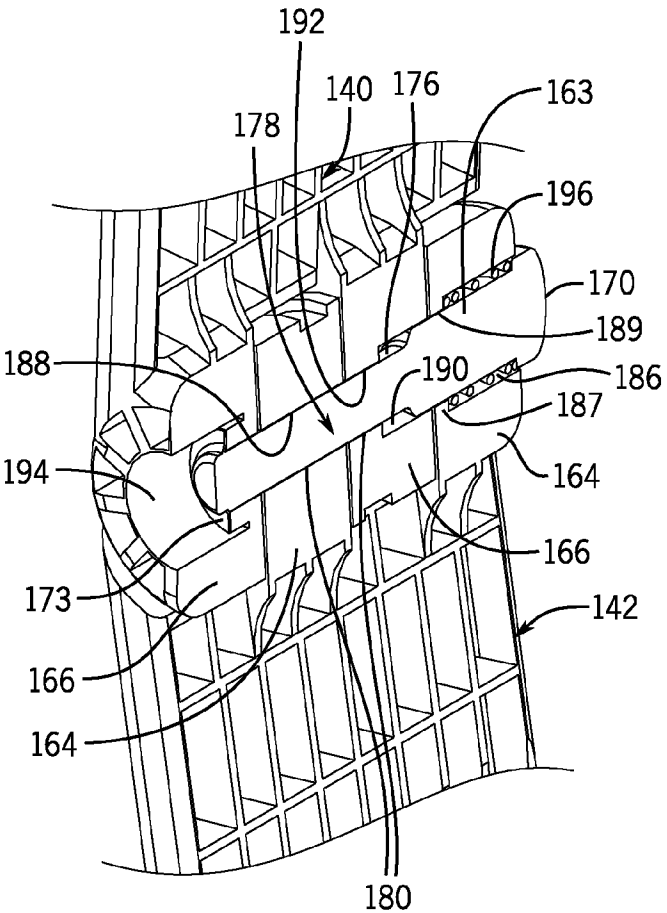
FIG. 12B shows a cross-section, similar to that of FIG. 12A, but taken along line 12B-12B in FIG. 3A.
Figure 12A:
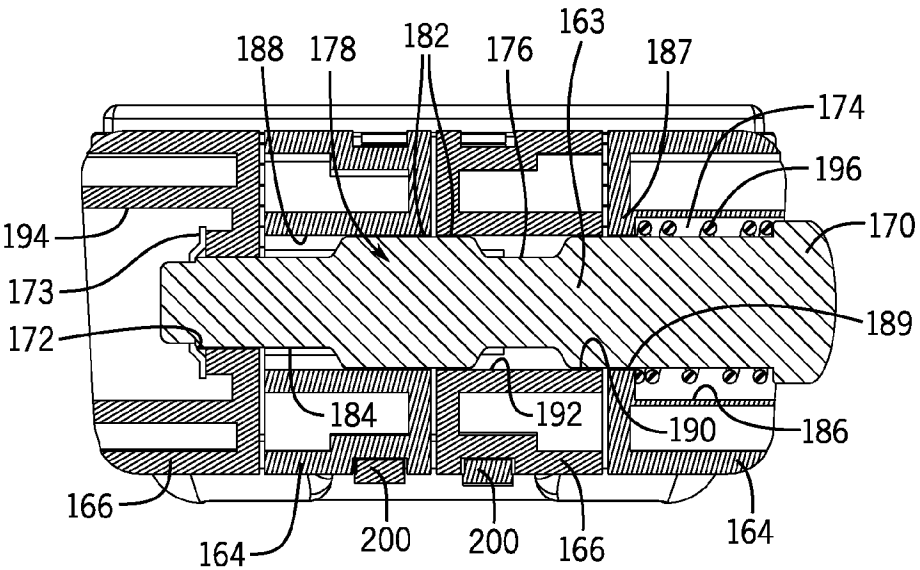
FIG. 12A shows a cross-section, similar to that of FIG. 11, but taken along line 12A-12A of the assembled frame shown in FIG. 3A with a latch of the pivot hub in a latched position.

FIGS. 12A and 12B show cross-sections of the pivot hub 72 of the left side assembly 56 in a latched condition. The upper and lower sections 140, 142 are thus in their respective extended positions or orientations that correspond to the deployed configuration of the frame 52. A latch spring 196 is concentric with the first part 174 of the latch pin 163. The latch spring 196 is borne against the shoulder 187 in the entry region and borne against the head 170. The latch spring 196 biases the latch pin 163 toward a latched position with the head 170 spaced from the shoulder 187, as shown in FIG. 12. In the latched position and in the deployed configuration, the flat segments 180 on the keyed part 178 of the latch pin 163 are seated partly within the keyed portion 192 on the knuckle portion 164 and partly within the keyed region 188 in the adjacent knuckle portion 166. In this latch position, the upper and lower sections 140, 142 are locked by the shaped keyed part 178 of the latch pin and cannot rotate relative to one another.

Figure 13B:
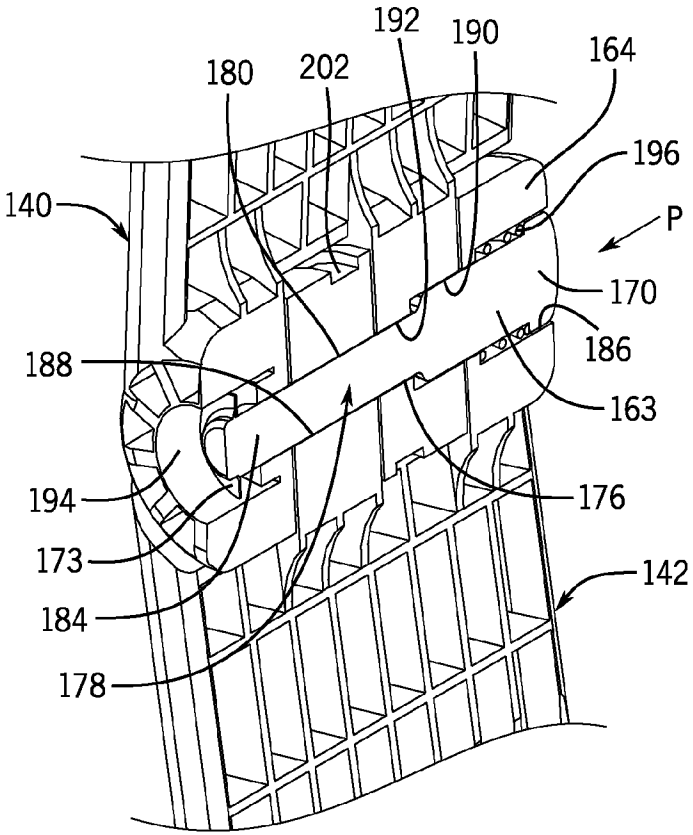
FIGS. 13A and 13B respectively show the pivot hub of FIGS. 12A and 12B, but with the latch in an unlatched position.
Figure 13A:
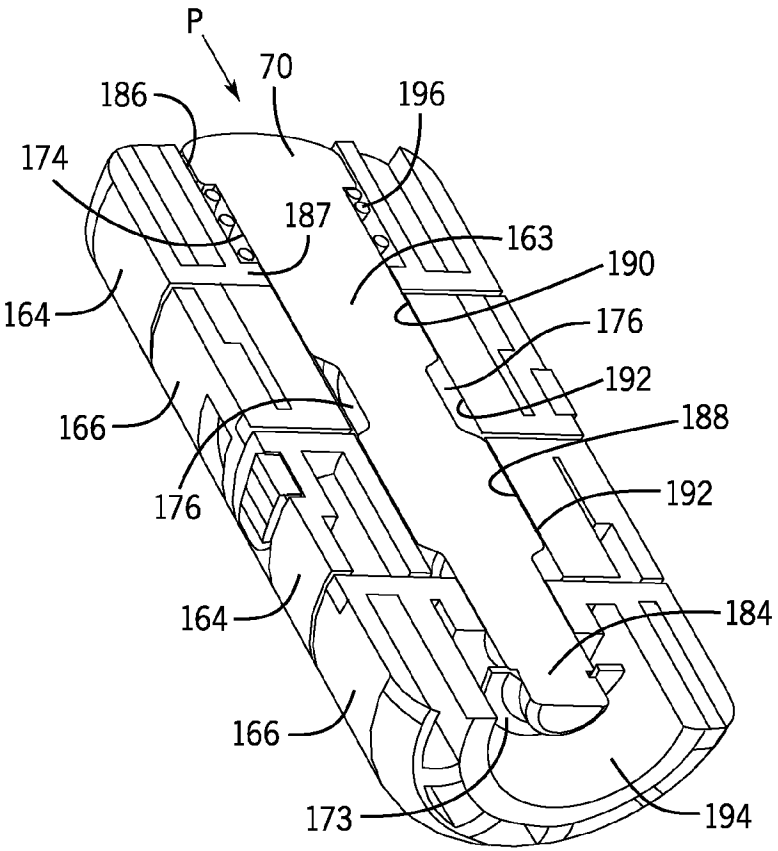
Figure 14B:
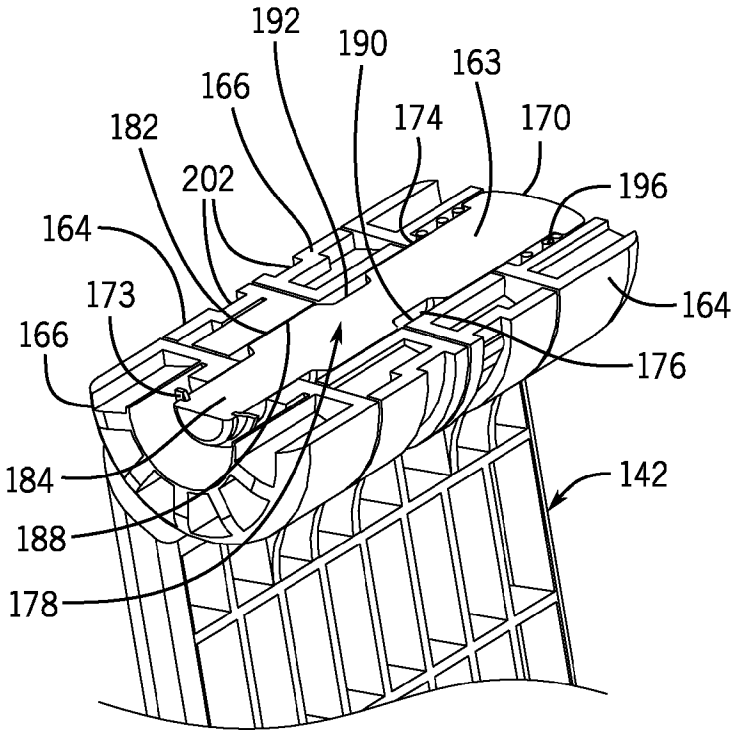
FIG. 14B shows the assembled pivot hub of FIGS. 12A and 13A, but with the upper and lower sections rotated as shown in FIG. 14A.
Figure 14A:
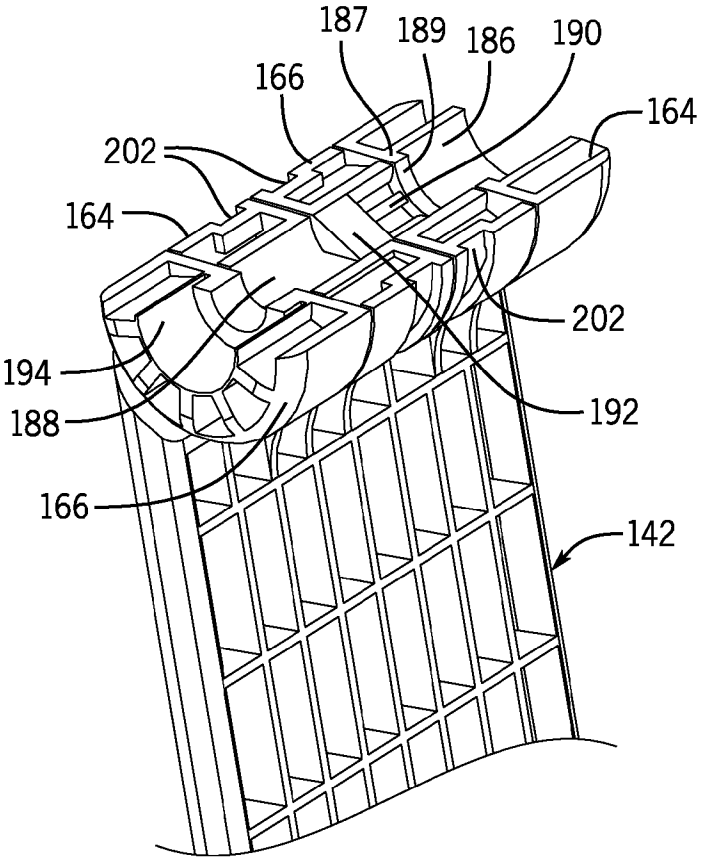
FIG. 14A shows the left side assembly of FIG. 11, but with the upper and lower sections pivoted part way between their extended and folded orientations.

As shown in FIGS. 13A and 13B, the head 170 of the latch pin 163 can be pushed in the direction of the arrow P to an unlatched position into the entry region 186 against the bias force of the spring 196. In the unlatched position, the keyed part 178 on the latch pin 163 translates axially along the pin bore 186 and seats entirely within the keyed region 188 in the knuckle portion 166. This unlocks the latch of the pivot hub 72, allowing the knuckle portions 164, 166 to rotate relative to one another. When the upper and lower portions are rotated about the latch in 163, the respective flats in the keyed portion 192 on the knuckle section 164 and the keyed region 188 on the adjacent knuckle section 166 become misaligned as shown in FIGS. 14A and 14B. The keyed part 178 on the latch pin 163 will thus be prevented from returning into the keyed portion 192 in the knuckle section 164 because it would no longer match up with the keyed portion. The latch pin 163 will thus be prevented from firing back to the latched position of FIGS. 12A and 12B. This leaves the upper and lower sections 140, 142 of the left side assembly 56 free to further rotate relative to one another as represented in FIG. 14B.

The right side assembly 56 can have the identical construction as the left side. Alternatively, as in this example, the right side can be a mirror image of the left side, but with the latch pin oriented with the head 170 facing in the same direction as the left side latch pin. Thus, the upper and lower sections on the right side would be flipped, having the lower section 142 above the upper section as shown in the drawings.

As shown in FIGS. 10A and 10B, a stop finger 200 protrudes lengthwise outward from the proximal end 160 of the left side upper section 140 between the knuckle portions 164. Likewise, a stop finger 200 protrudes lengthwise outward from the proximal end 162 of the lower section 142 between the corresponding knuckle portions 166. A finger groove 202 is formed along part of the circumferential exterior surface 204 of one of the knuckle portions 164 and 166 on each of the upper and lower sections 140, 142. Each guide groove 202 terminates at a stop surface 208 and each stop finger 200, 202 terminates at an end face 210. The length of the stop fingers 200 and finger grooves 202, and the positioning of the stop surfaces 208 and the end faces 210 are designed to define and limit the rotational travel of the upper and lower section 140, 142 moving toward the deployed position. When the frame 52 is moved from the compact configuration of FIGS. 4A and 4B to the deployed configuration of FIGS. 3A and 3B, the upper and lower sections 140, 142 will pivot relative to one another about the latch pin 163 toward their deployed positions. The stop surfaces 208 and end faces 210 will meet and abut one another when the keyed portion 192 and keyed region 188 of the pin bore 168 align with one another. At this orientation, the latch spring 196 can and will fire the latch pin 163 back to the latched position of FIGS. 12A and 12B.

Figure 15B:
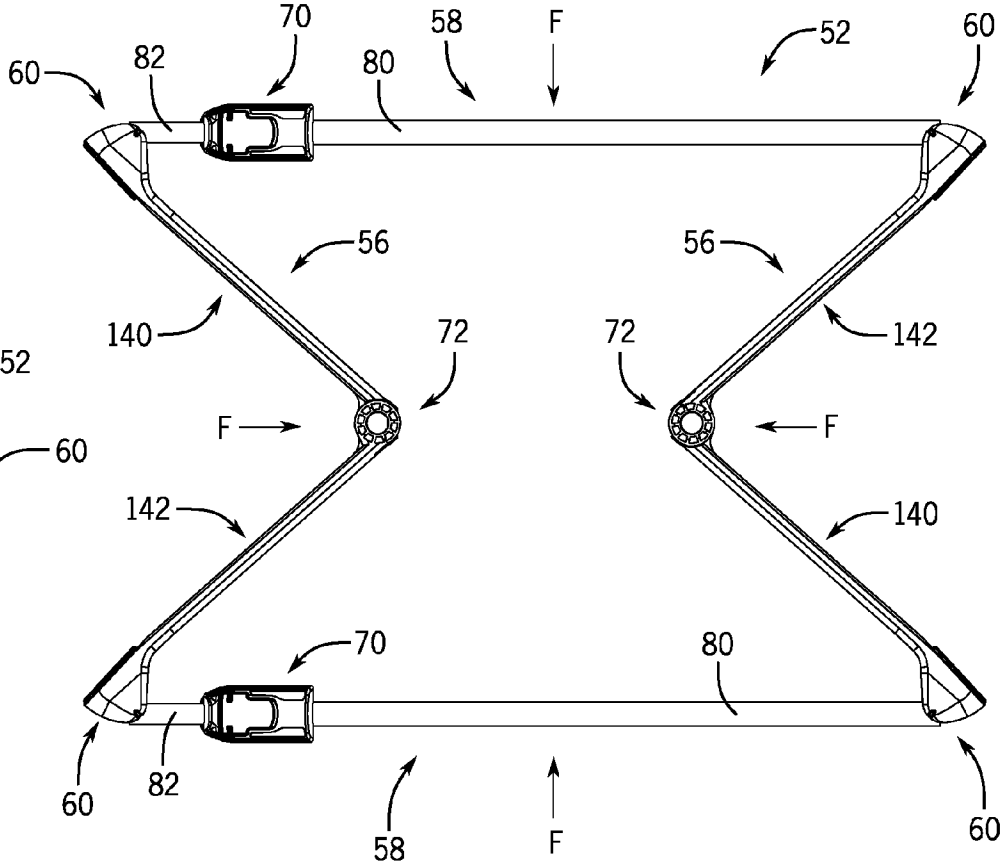
FIGS. 15A and 15B show a perspective front view and a front view, respectively, of the frame shown in FIGS. 3A and 3B, but in a partly folded configuration.
Figure 15A:
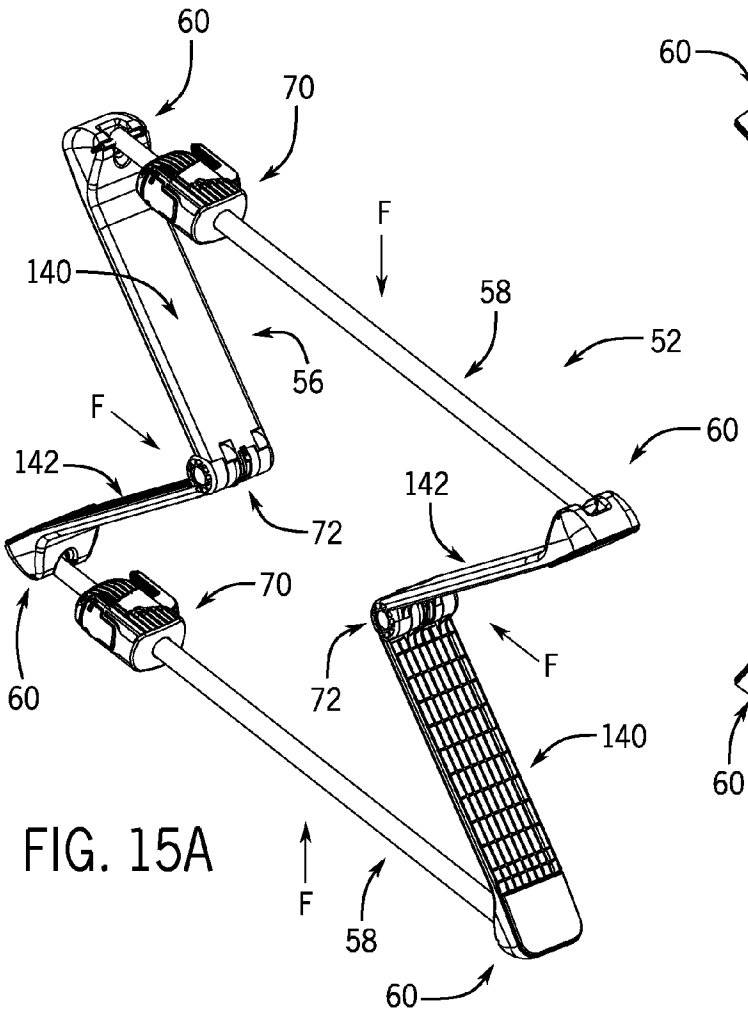
Figure 16:
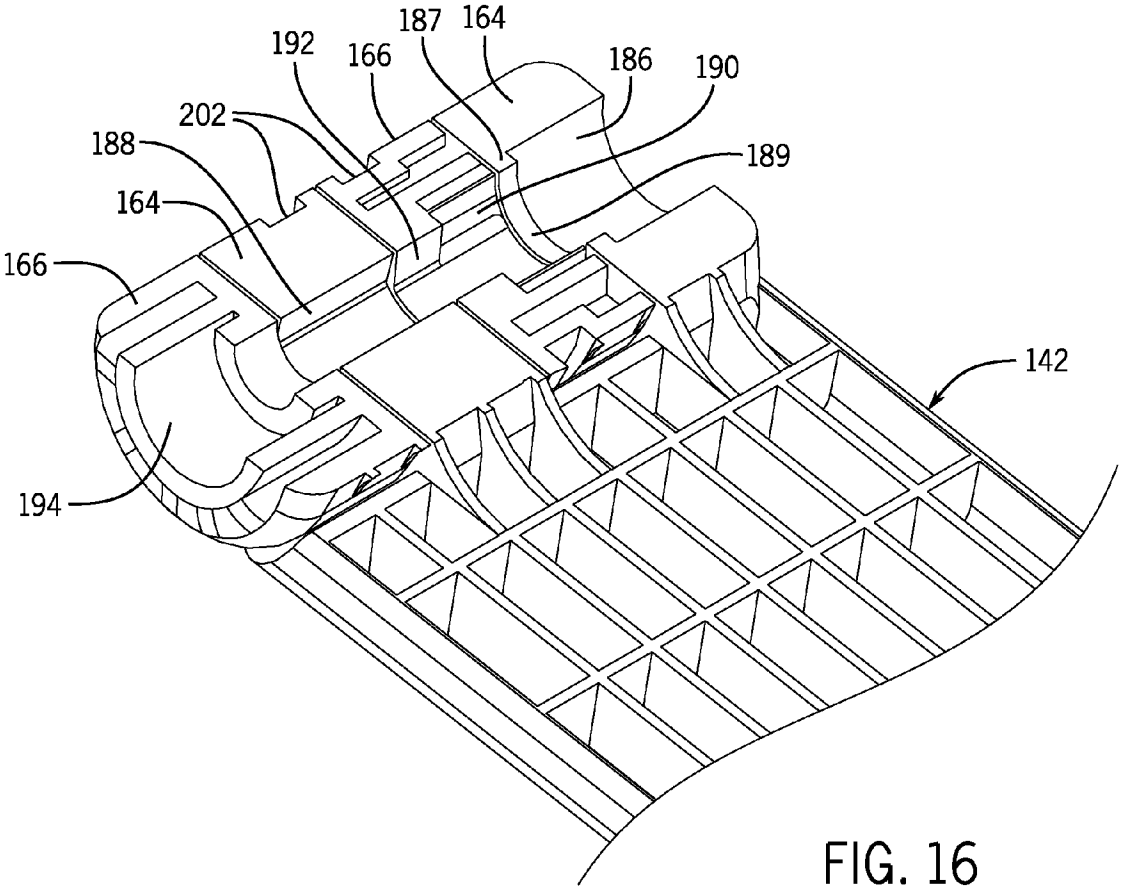
FIG. 16 shows the left side assembly of FIGS. 11 and 14A, but with the upper and lower sections in their folded, compact orientations of FIGS. 4A and 4B

During use, the safety gate 50 can be folded from the deployed configuration to the compact configuration by first pushing in the latch pins 163 to the unlatched positions of FIGS. 13A and 13B. When the latch pins 163 are unlatched, the left and right side assemblies 56 can be rotated slightly, misaligning the keyed portions 192 and keyed region 188 within the latch bore 168. This will retain or hold the latch pins 163 in the unlatched position. The side assemblies 56 can then be folded inward and the top and bottom assemblies 58 can then be folded toward one another. The upper and lower sections 140, 142 of each of the side assembly 56 will fold inward onto one another between the top and bottom assemblies 58 as shown in FIGS. 15A and 15B, and FIGS. 4A and 4B. As shown in FIG. 16, the bore portions remain misaligned in this example with the safety gate 50 in the folded, compact configuration. Thus, in order to deploy the safety gate 50 from the compact configuration of FIGS. 4A and 4B, the user need only lift the top assembly 58 from the bottom assembly 58 until the latch pins 163 fire to the latched positions, thereby retaining the left and right side assembly in the extended orientation and the safety gate in the deployed configuration.

To remove the safety gate 90 from an opening and fold the gate, the jack mechanisms 70 should first be released. This can be done by manipulating the brake plates 124 as discussed above. The release mechanisms allow the top and bottom assemblies 58 to be retraced to the shorted deployed configuration of FIGS. 3A and 3B. Simultaneously or subsequently, the upper and lower sections 140, 142 of each side assembly 56 can be released by unlatching the latch pins 163 as described above. The sections 140, 142 can then begin to be folded inward towards one another by applying a force in the direction of the arrows F as shown in FIGS. 15A and 15B. The force F can be applied to the pivot hubs 72, other points on the upper and lower sections 140, 142, and/or to the top assembly 58.

From the partially folded configuration shown in FIGS. 15A and 15B, the top and bottom assemblies 58 can be pushed further toward one another. This movement causes the upper and lower sections 140, 142 of the side assemblies 56 to fold further inward until the sections are generally parallel to in the folded orientation, lying against one another on each side assembly. As a result of this movement, the jack mechanism 70 are also driven closer together until the mechanisms are closely adjacent or touching one another. At this point, the safety gate 50 is in the compact folded configuration shown in FIGS. 4A and 4B. When the safety gate 50 is in this folded configuration, the user can conveniently and easily transport and/or store the safety gate.

In one alternative example, the pivot hub 72 can be configured without any type of latch. Instead, compression of the top and bottom assembly 58, once installed, can be solely relied upon to retain the overall shape of the frame 52. Alternatively, the pivot hubs can be configured to have an over-center condition that occurs just prior to achieving the deployed configuration. The over-center condition can help retain the side assemblies in the extended orientation. In another alternative example, the pivot hubs 72 can be configured to latch in both the extended orientation of the side assemblies as well as the compact position of the site assemblies. The latch pins and latch bores could be configured so as to latch in both positions, if desired. This would help retain the safety gate 50 in the compact configuration for easy storage and transport. The flats on the pivot pin and in the bore in this example could be arranged to realign in the folded, compact configuration and in the deployed configuration to accomplish this dual latching alternative.

In the disclosed example, each of the upper and lower sections 140, 142 is constructed as a generally flat plank having a depth much greater than a thickness of the plank. The sections 140, 142 can be molded plastic or other such material and have strengthening ribs 212 within a cavity forming the thickness of the structure. This can reduce weight of the safety gate 50 while providing a strong and durable product.

Each of the upper and lower sections has a remote end 214 with a pad 216 secured to an outward facing side 218 of the remote end, opposite the face carrying the trunnion 144. In the deployed configuration, the pads 216 and outward facing sides 218 are generally aligned in parallel with one another on each of the side assemblies 56. As shown in FIG. 1, for example, the main body portions 220 of each upper and lower section 140, 142 are oriented at a slightly non-parallel angle inward relative to the outward facing sides 218 of the remote ends 214. In the disclosed example, this slight angle is provided in order to accommodate the size and location of the pivot hubs 72. When installed, the pads 216 may bear against the surfaces of the opening into which the safety gate 50 is installed. The pivot hubs 72 will be slightly spaced from and not pressing against these surfaces of the opening, or they may touch the surfaces but not under significant pressure to avoid damage to the surfaces.

The pads 216 can be provided having a desired thickness, resiliency, durometer, surface texture, and the like. These aspects of the pad can produce a desired grip or friction against the surfaces of the opening into which the gate is installed. The pads 216 can be configured to take up slight angular variations, contours, bumps, depressions, etc. in the surfaces of the opening. Thus, the pads 216 can assure good surface contact regardless as to whether the surfaces themselves are irregular or non-flat, or whether the surfaces are out of square with other portions of the surfaces in the opening. It is also possible that feet can be provided on the outward facing sides 218 of the upper and lower sections 140, 142 whereby the feet are capable of slight relative, angular adjustment or movement to account for such surface irregularities. The feet could be connected to the upper and lower sections by a ball and socket joints permitting such relative movement, if desired.

The disclosed safety gate 50 is easily and securely widthwise adjustable. The gate 50 is also easily foldable to a compact configuration and also easily deployed. The free ends 138 of the top and bottom assemblies 58 can be attached to and detached from the trunnions 144 on the side assemblies 56 in this example. This can permit the safety gate 50 to be further broken down, if desired, whether to reduce the shipping cube size and/or to reduce retail shelf space required.

The upper and lower jack mechanisms 70 allow a user to extend or lengthen the upper and lower tube assemblies quickly and easily. The jack mechanisms also allow the user to micro-adjust the width of the safety gate 50 in fine increments so as to securely fit into virtually any size opening within the limits of the size of the fixed segment 80 and adjustable segment 82 of the top and bottom assemblies 58. The top and bottom assemblies need not be identical to or mirror images of one another. Likewise, the left and right side assemblies 56 need not be identical to or minor images of one another.

In other examples, the top and bottom assemblies 58 can be shaped or sized differently, such as having a panel shape or plank shape like the side assemblies 56. Alternatively, the side assemblies can be tube shaped like the top and bottom assemblies 58. In other examples, the upper and lower sections 140, 142 and fixed and adjustable segments 80, 82 may also be coupled together in a different manners than the examples shown and described herein. The gate may utilize a different hinge or pivot components to connect the upper and lower sections 140, 142 together. Another connection mechanism can be used to connect the sections, allowing the sections to be rotated, slidably adjusted, or otherwise folded relative to one another when desired.

The jack mechanisms 70 can also very in configuration and construction. The component arrangement for the drive mechanism and the release mechanism can vary from the example shown and described herein. In one example, the release mechanism can include a cover that, when pivoted open, automatically moves the brake plate to a release orientation. The cover could have a flex finger in direct contact with the brake plate working end 130 that moves the brake plate upon rotating the cover. Such a release mechanism would require only one step instead of the two (open cover, move brake plate) required in the disclosed example. The adjustable segment or tube 82 can have a shaped surface near the proximal end that limits the function of the jack mechanism beyond a specified extend position. The shaped surface can be such that the drive plate 100 no longer can bite into the surface 114, preventing further incremental extension of the segment by the jack mechanism.

The segments 80, 82 or tubes can be round, oval, square, or any other suitable shape in cross-section. The tube assembly can also be constructed of two planar, interlocking plates slidably connected to one another. The springs disclosed herein are conventional compression springs. However, the springs for the pivot hub and the jack mechanisms can be other types of springs such as torsion springs, leaf springs, or the like. The lever 90 is L-shaped in this example. The lever 90 is pivotable about the pivot pins 97 in this example. However, the lever 90 can pivot about any pin or axle configuration that extends laterally relative to the housing 84 and body 96. The pins 97 or other structure can seat in pivot pockets in the first cavity 92 of the housing 84. The shape, structure, and configuration of the lever 90 can also vary from the example shown and described herein. In other examples, the grip and/or body may have a different shape and size. The lever may also be configured to be squeezed or actuated in a different manner than described herein. The cavities in the housing 84 can also vary, as can the functional surfaces therein.

Each squeezing action of the lever 90 causes the adjustable segment 82 to incrementally slide out of the fixed segment, slightly extending the length of the tube top or bottom assembly 58. The amount or degree of incremental movement permissible by the jack mechanism can be designed and predetermined by altering the lever travel, various surface angles, cavity sizes, plate through-hole sizes, plate and surface orientations, and the like. The number and size of the springs can be altered to change the squeeze force required to actuate the lever 90. One single spring instead of two springs could be arranged in the housing to bias both the brake and drive plates, if desired.

Although certain safety gate features, methods, components, and constructions have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A safety gate comprising:

a frame having top and bottom assemblies spaced apart in a vertical direction and having opposed side assemblies spaced apart in a horizontal direction in a deployed configuration, a length of the top and bottom assemblies being extendable and retractable to adjust a width of the frame between the opposed side assemblies;

a flexible barrier connected to and supported by the frame, and a one-way jack mechanism carried on each of the top and bottom assemblies, each one-way jack mechanism having a lever and each lever lying generally parallel to the respective top or bottom assembly in a home position, wherein the length of the top and bottom assemblies can be extended without actuating the jack mechanisms to adjust the frame to a desired width to nearly fit a space between two surfaces, and wherein the levers of the one-way jack mechanisms, when actuated, move toward the respective top or bottom assembly and incrementally further extend the length of the top and bottom assemblies such that the frame interferingly fits between the two surfaces under compression, and wherein actuation of the levers further extends the top and bottom assemblies in a direction of extension and neither actuation nor return of the levers retracts the top and bottom assemblies in an opposite direction of retraction.

2. A safety gate according to claim 1, wherein the barrier covers a substantial portion of an opening in the frame within the top, bottom, and opposed side assemblies.

3. A safety gate according to claim 2, wherein the barrier is coupled to the top and bottom assemblies and to the opposed side assemblies and is extendable and retractable as the width of the frame is adjusted.

4. A safety gate according to claim 1, wherein each lever is a squeezable lever that, when squeezed from the home position, incrementally further extends the length of the respective top or bottom assembly and when released returns to the home position generally parallel with the respective top or bottom assembly and leaving the respective top or bottom assembly in the incrementally extended length.

5. A safety gate according to claim 1, wherein the top and bottom assemblies each have a fixed segment and an adjustable segment telescopically slidable along and relative to the fixed segment.

6. A safety gate according to claim 5, wherein each jack mechanism is connected to and positionally fixed lengthwise along the respective fixed segment, whereby actuating the jack mechanism incrementally further extends the adjustable segment relative to and telescopically along the fixed segment.

7. A safety gate according to claim 5, wherein each lever is a squeezable lever that, when squeezed from the home position and released back to the home position, incrementally further extends the adjustable segment.

8. A safety gate according to claim 5, wherein each jack mechanism prevents the adjustable segment from being retracted back along the respective fixed segment unless the jack mechanism is released.

9. A safety gate according to claim 8, wherein each jack mechanism has a release mechanism actuable to release the respective adjustable segment so as to be retractable back along the fixed segment.

10. A safety gate according to claim 1, wherein the frame is foldable to a compact configuration with the top and bottom assemblies positioned closely adjacent and generally parallel to one another and with the opposed side assemblies folded therebetween.

11. A safety gate according to claim 1, wherein the frame is reconfigurable from the deployed configuration to a compact configuration, the side assemblies each having a latch that locks the frame in the deployed configuration and that can be unlatched to allow the frame to be folded.

12. A safety gate comprising:

a frame having top and bottom assemblies and opposed side assemblies, the frame reconfigurable between a compact configuration and a deployed configuration;

a flexible barrier connected to and supported by the frame; and a one-way jack mechanism carried on each of the top and bottom assemblies, each one-way jack mechanism having a housing, a lever extending from one side of the housing, and a release element positioned on an opposing side of the housing wherein a length of each of the top and bottom assemblies can be extended to adjust the frame to loosely fit between two surfaces without operating the one-way jack mechanisms, wherein the levers, when actuated from a home position, incrementally extend the lengths of the top and bottom assemblies such that the frame can interferingly fit between two surfaces under compression in the deployed configuration, wherein, in the compact configuration, the top and bottom assemblies are closely spaced and generally parallel to one another and the opposed side assemblies are folded between or adjacent the top and bottom assemblies, wherein, in the deployed configuration, the levers are actuable from and returnable one or multiple times to the home position whereby each actuation incrementally extends the length of the top and bottom assemblies in one direction and each return does not retract the length of the top and bottom assemblies in a direction opposite the one direction, and wherein the release element is actuable to release the one-way jack mechanisms allowing the length of the top and bottom assemblies to be retracted.

13. A safety gate according to claim 12, wherein the opposed side assemblies each have an upper section and a lower section connected to one another at a central hinge and pivotable between an extended orientation and a folded orientation corresponding to the deployed and compact configurations, respectively, of the frame.

14. A safety gate according to claim 13, wherein each central hinge has a latch configured in a latched position to lock the respective side assemblies in the extended orientation.

15. A safety gate according to claim 14, wherein each latch can be selectively unlatched by pushing a corresponding pin, which unlocks the respective upper and lower sections, each corresponding pin defining a single pivot axis of the respective hinge about which the upper and lower section of each side assembly pivot relative to one another.

16. A safety gate according to claim 15, wherein the pins are spring biased to the latched position.

17. A safety gate according to claim 14, wherein each latch comprises:

a hinge knuckle defined in part on an end of each of the upper and lower sections;

a bore extending axially along the hinge knuckle and formed in part by each of the upper and lower sections, the bore having differently shaped circumferential portions spaced along its length; and a latch pin within the bore and having differently shaped circumferential segments spaced along its length, the latch pin being axially movable between a latched position and an unlatched position, wherein the differently shaped portions and segments cooperate to permit relative rotation about the pin between the upper and lower sections of the opposed side assemblies in the unlatched position and to prevent such relative rotation in the latched position.

18. A safety gate according to claim 17, wherein the latch pins, upon movement to the unlatched position, are held in the unlatched released position by misaligned portions of the bore when the upper and lower sections are pivoted from the deployed configuration toward the compact configuration.

19. A safety gate according to claim 12, wherein the length of the top and bottom assemblies can be extended without actuating the jack mechanisms in the deployed configuration to adjust the frame to a desired width to nearly fit a space between the two surfaces before actuating the jack mechanisms.

20. A safety gate comprising:

a frame having top and bottom assemblies and opposed side assemblies and being reconfigurable between a compact configuration with the side assemblies in a folded orientation and a deployed configuration with the side assemblies in an extended orientation, a length of each of the top and bottom assemblies freely extendable to loosely fit between two surfaces;

a one-way jack mechanism carried on each of the top and bottom assemblies, each one-way jack mechanism having a squeezable lever lying generally parallel to the respective top or bottom assembly in a home position and that, when actuated from the home position moves toward the respective top or bottom assembly and, incrementally extends the lengths of the respective top or bottom assembly such that the frame can interferingly fit between two surfaces under compression in the deployed configuration;

a central hinge pivotally connecting an upper section and a lower section on each of the opposed side assemblies;

a flexible barrier connected to and supported by the frame; and a latch at each of the central hinges, wherein the latches lock the central hinges with the side assemblies in the extended orientation and the frame in the deployed configuration, wherein each central hinge is unlocked by pushing a pin to an unlatched position allowing the side assemblies to pivot to the folded orientation and the frame to fold to the compact configuration, and wherein actuation and return of the levers one or more times further extends the top and bottom assemblies in a direction of extension but does not retract the top and bottom assemblies in an opposite direction of retraction.

21. A safety gate according to claim 12, wherein each lever is generally parallel to the respective top or bottom assembly and is actuable and releasable toward the respective top or bottom assembly to incrementally adjust the length of the top and bottom assemblies.

22. A safety gate according to claim 12, further comprising the release element being positioned in a recess on the housing, the recess being closed off or hidden by a movable cover.

* * * * *